US006148563A

United States Patent [19]

Roche et al.

[11] Patent Number: 6,148,563

[45] Date of Patent: Nov. 21, 2000

[54] REACH-IN DOOR FOR REFRIGERATED MERCHANDISER

[75] Inventors: John M. Roche, Ballwin; John A. Behr, Defiance; John M. Rasch, St. Charles, all of Mo.

[73] Assignee: Hussmann Corporation, Bridgeton, Mo.

[21] Appl. No.: 09/276,456

[22] Filed: Mar. 25, 1999

[51] Int. Cl.[7] ..... E06B 3/00

[52] U.S. Cl. ..... 49/501

[58] Field of Search ..... 49/501, 70, 325, 49/381, 478.1; 16/277, 298, 299, 301, 308; 52/171.3, 173.1, 208, 397, 398, 790, 789, 521

[56] References Cited

U.S. PATENT DOCUMENTS

| | | | |
|---|---|---|---|
| Re. 35,120 | 12/1995 | Heaney | 312/116 |
| 2,701,395 | 2/1955 | Barroerro | 20/35 |
| 3,091,819 | 6/1963 | Wheeler et al. | 20/16 |
| 3,124,848 | 3/1964 | Wheeler et al. | 20/16 |
| 3,161,925 | 12/1964 | Bertolini | 20/69 |
| 3,248,533 | 4/1966 | Watkins | 240/51.11 |
| 3,331,159 | 7/1967 | Cooke et al. | 49/371 |
| 3,381,340 | 5/1968 | Chapin, Jr. | 18/36 |
| 3,448,260 | 6/1969 | Wince et al. | 240/93 |
| 3,507,074 | 4/1970 | Gallegos | 49/386 |
| 3,510,986 | 5/1970 | Berkowitz | 49/386 |
| 3,612,821 | 10/1971 | Stromquist | 219/218 |
| 3,673,735 | 7/1972 | Winsler et al. | 49/70 |
| 3,703,425 | 11/1972 | Delmonte et al. | 156/24 |
| 3,724,129 | 4/1973 | Stromquist | 49/70 |
| 3,837,119 | 9/1974 | Conneally et al. | 49/404 |
| 3,859,502 | 1/1975 | Heaney | 219/218 |
| 3,882,637 | 5/1975 | Lindenschmidt | 49/501 |
| 4,004,370 | 1/1977 | Heaney | 49/70 |
| 4,084,347 | 4/1978 | Brown | 49/397 |
| 4,127,765 | 11/1978 | Heaney | 219/218 |
| 4,135,369 | 1/1979 | Allgeyer et al. | 62/251 |
| 4,145,844 | 3/1979 | Kaspar | 49/386 |
| 4,151,696 | 5/1979 | Knights et al. | 52/741 |
| 4,223,482 | 9/1980 | Barroero et al. | 49/386 |
| 4,237,597 | 12/1980 | Auger | 29/526 R |
| 4,249,517 | 2/1981 | Schroeder et al. | 126/450 |
| 4,259,135 | 3/1981 | Kulla | 156/293 |
| 4,260,876 | 4/1981 | Hochheiser | 219/497 |
| 4,306,140 | 12/1981 | Stromquist | 219/522 |

(List continued on next page.)

FOREIGN PATENT DOCUMENTS 580944 8/1959 Canada .

*Primary Examiner*—Alvin Chin-Shue
*Assistant Examiner*—Curtis A. Cohen
*Attorney, Agent, or Firm*—Richard G. Heywood

[57] ABSTRACT

A refrigerated, reach-in merchandiser having a product display area with a front opening defined by casing means having at least two mullion members, a reach-in door for closing the front opening and being hingedly mounted on one of the mullion members by door control means, said reach-in door having a transparent panel with a molded frame and at least two glass lites, a door control for hingedly mounting the door on said merchandiser, an electric member for said merchandiser including a light on one of the mullion members for illuminating the display area, said electric member also including a heating element for the glass lites of the transparent panel and including a key member for connecting said heating element to said merchandiser.

79 Claims, 17 Drawing Sheets

U.S. PATENT DOCUMENTS

| | | | |
|---|---|---|---|
| 4,336,009 | 6/1982 | Wolf | 425/116 |
| 4,369,631 | 1/1983 | Abraham | 62/82 |
| 4,382,177 | 5/1983 | Heaney | 219/522 |
| 4,416,086 | 11/1983 | Niekrasz | 49/388 |
| 4,429,509 | 2/1984 | Vachet et al. | 52/788 |
| 4,430,770 | 2/1984 | Niekrasz et al. | 16/80 |
| 4,431,691 | 2/1984 | Greenlee | 428/34 |
| 4,477,129 | 10/1984 | Heaney | 312/116 |
| 4,478,003 | 10/1984 | Flett | 49/63 |
| 4,561,625 | 12/1985 | Weaver | 249/85 |
| 4,578,902 | 4/1986 | Niekrasz et al. | 49/70 |
| 4,609,978 | 9/1986 | Hsieh et al. | 362/335 |
| 4,626,185 | 12/1986 | Monnet | 425/110 |
| 4,637,167 | 1/1987 | Svensson | 49/386 |
| 4,644,454 | 2/1987 | Herst et al. | 362/224 |
| 4,646,472 | 3/1987 | Sugawara | 49/386 |
| 4,648,832 | 3/1987 | Reilly et al. | 425/543 |
| 4,671,582 | 6/1987 | Stromquist et al. | 439/31 |
| 4,686,806 | 8/1987 | Bennett | 52/309.4 |
| 4,692,963 | 9/1987 | Barroero | 16/275 |
| 4,695,420 | 9/1987 | Grawley et al. | 264/265 |
| 4,696,078 | 9/1987 | Stromquist | 16/301 |
| 4,753,043 | 6/1988 | Bockwinkel | 49/501 |
| 4,760,621 | 8/1988 | Stromquist | 16/85 |
| 4,831,780 | 5/1989 | Bockwinkel | 49/504 |
| 4,905,347 | 3/1990 | Worth | 16/308 |
| 4,948,206 | 8/1990 | Fitzpatrick | 312/296 |
| 4,951,927 | 8/1990 | Johnston et al. | 264/129 |
| 4,998,382 | 3/1991 | Kostos et al. | 49/501 |
| 5,016,146 | 5/1991 | Kaspar | 362/92 |
| 5,035,085 | 7/1991 | Mamelson et al. | 49/504 |
| 5,061,531 | 10/1991 | Catalano | 428/34 |
| 5,097,642 | 3/1992 | Richardson et al. | 52/171 |
| 5,113,628 | 5/1992 | Richardson et al. | 52/171 |
| 5,228,240 | 7/1993 | Barroero et al. | 49/386 |
| 5,255,473 | 10/1993 | Kasper et al. | 49/501 |
| 5,301,092 | 4/1994 | Santosuosso et al. | 362/125 |
| 5,315,211 | 5/1994 | Ditlevsen et al. | 315/50 |
| 5,471,372 | 11/1995 | Mamelson et al. | 362/92 |
| 5,544,454 | 8/1996 | Richardson et al. | 52/171.1 |
| 5,687,509 | 11/1997 | Barroero et al. | 49/386 |
| 5,967,226 | 10/1999 | Choi | 165/63 |

REACH-IN DOOR FOR REFRIGERATED MERCHANDISER

BACKGROUND OF THE INVENTION (a) Field of the Invention

This invention relates generally to the commercial refrigeration art, and more particularly to improvements in glass front product merchandisers (so-called "reach-ins") which hold and display medium and low temperature foods, including specifically doors for such reach-in merchandisers.

(b) Description of the Prior Art

Frozen food merchandisers are designed with the primary objective of maintaining product temperatures in the display area at about 0° F. for frozen food and −10° F. for ice cream, which in the past have required evaporator coil temperatures in the range of −10° F. down to −35° F. Medium temperature merchandisers maintain fresh product temperatures generally in the range of 30° F. to 40° F.

Multi-shelf reach-in merchandisers for storage and display of fresh and frozen food products (including ice cream) provide a generally vertical display of the product for greater visibility and product accessability to shoppers. In order to prevent the escape of cold air into the shopping arena, the display area of the merchandiser is closed by a glass front door. Glass is a poor thermal insulator so the doors are conventionally formed by two or three spaced apart panes of glass, defining one or two air spaces to increase the thermal insulation of the door.

The air spaces must be sealed for maximum insulating effect, and to prevent entry of moisture into these air spaces. Moisture in the air space condenses on the cold glass and obscures viewing of the product in the merchandiser. In the past, sealing of the air space has been accomplished by forming a an "insulating glass unit" or "IG unit"(sometimes called a "glass pack") which consists of opposing glass panes (called "lights" or "lites") separated by a metallic spacer secured by a suitable polymer (e.g., polysulfide, polyisobutylene, etc.). The glass pack is placed in a metal frame to complete the door. Thus, the door assembly process involves two separate steps of forming sealed air spaces, followed by forming a metal frame. Metal is most typically used in the frame and in the spacers because it has a good strength-to-weight ratio. In addition, metal is an excellent moisture barrier and when used as a spacer seals the air space from moisture for many years. However, metal has two important drawbacks when used in reach-in doors. The first is that metal is a poor thermal insulator, and the second is that metal is an excellent electrical conductor.

Conventional attempts to attenuate thermal conduction through the metal in the door generally involve placing barriers in the path of thermal conduction. Others have attempted to partially or entirely replace the metal frame with a polymeric material having a substantially lower thermal conductivity. Examples of such doors are shown in U.S. Pat. Nos. 5,097,642 and 5,228,240. However, it will be noted that in these prior art attempts to reduce the metal used in the doors have not eliminated the metallic spacers, nor have they replaced the need for sealing glass lites before forming the frame.

The electrical conductivity of metal is a hindrance because electrical power is used to heat one or more surfaces of the glass lites in the door. Heating is needed in order to prevent condensation from collecting and obscuring vision through the glass panes of the door. For instance, the moisture in the relatively warm ambient air of the store readily condenses on the outside of the door if it were not heated. Also, when the door is opened moisture condenses on the cold inside glass surface. Without heating, this condensation would not clear quickly and so the view of the product in the merchandiser would be obscured. Typically, heating is achieved by placing a semi-conductive film (e.g., tin-oxide) on the inner surface of the outer glass lite in the door. Bus bars along opposing edges of the lite provide an electrical potential causing a current to flow through the film and produce heat. It is presently necessary to keep the wiring and bus bars supplying the electric power carefully insulated and isolated from the outer metal door frame and the inner metal spacer. This means that a portion of the heating film had to be eliminated at the edge margin where there would be contact with metal. The primary danger occurs when a glass lite is shattered thus exposing the wiring to human contact and electrical shock. Conventionally, expensive electrical circuit breakers, such as ground fault interrupts and fused links, have been used to prevent accidental electrical shock in case of glass breakage.

SUMMARY OF THE INVENTION

The invention is embodied in a refrigerated, reaching merchandiser having a product display area with a front opening defined by casing means having at least two mullion members, a reach-in door for closing the front opening and being hingedly mounted on one of the mullion members by door control means, said reach-in door having a transparent panel with a molded frame and at least two glass lites, door control means for hingedly mounting the door on said merchandiser, electric means for said merchandiser including lighting means on one of the mullion members for illuminating the display area, said electric means also including heating means for the glass lites of the transparent panel and including a key member for connecting said heating means to said merchandiser. The invention is further embodied in a transparent door for a refrigerated enclosure having a molded frame, and a method of making the same.

A principal object of the present invention is to provide a reach-in product display merchandiser having door and casing improvements providing thermal insulation, better low-glare lighting, safer electrical isolation, secure door hinging and closure features and improved manufacturing.

A more specific object is to provide a reach-in door having low thermal conductivity in which air spaces between glass lites of the doors are effectively sealed upon formation of the molded door frame.

Another object of the invention is to provide a reach-in door which maintains a barrier to moisture entering the air spaces between glass lites.

Another object is to provide a reach-in door which is more thermally insulated and therefore more energy efficient.

Another object is to provide a reach-in door incorporating electrically insulating means simplifying the construction and installation of the door necessary to permit heating of one or more glass lites of the door and to reduce the risk of accidental shock in case of breakage of the lites.

Another object is to provide a reach-in door with a simplified torsion adjustment feature.

Another object is to provide a reach-in merchandiser having improved non-glare interior lighting for viewing of product in the merchandiser.

These and other objects and advantages will become apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENTS

Figure 1:
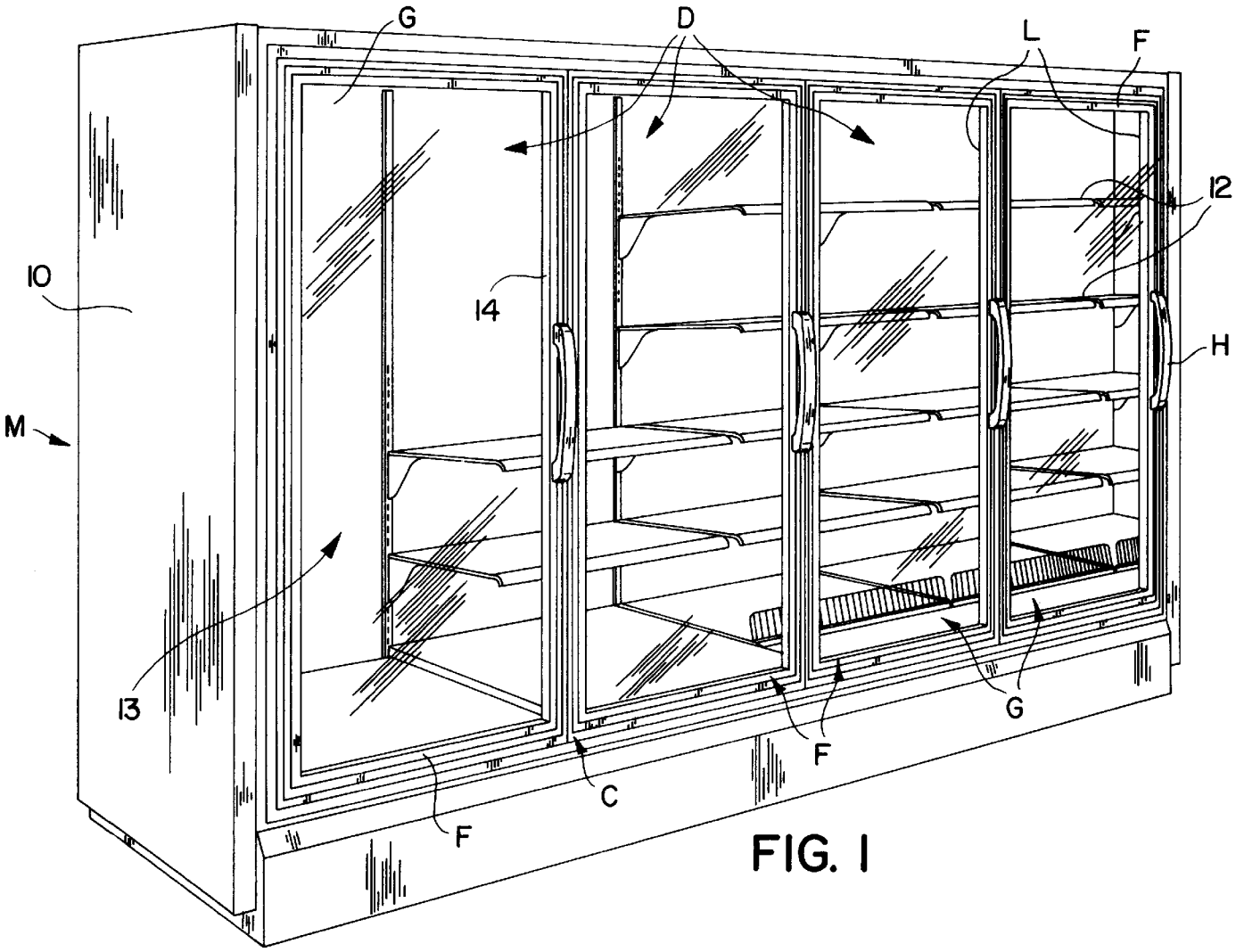
FIG. 1 is an perspective view of a refrigerated reach-in merchandiser.
Figure 2:
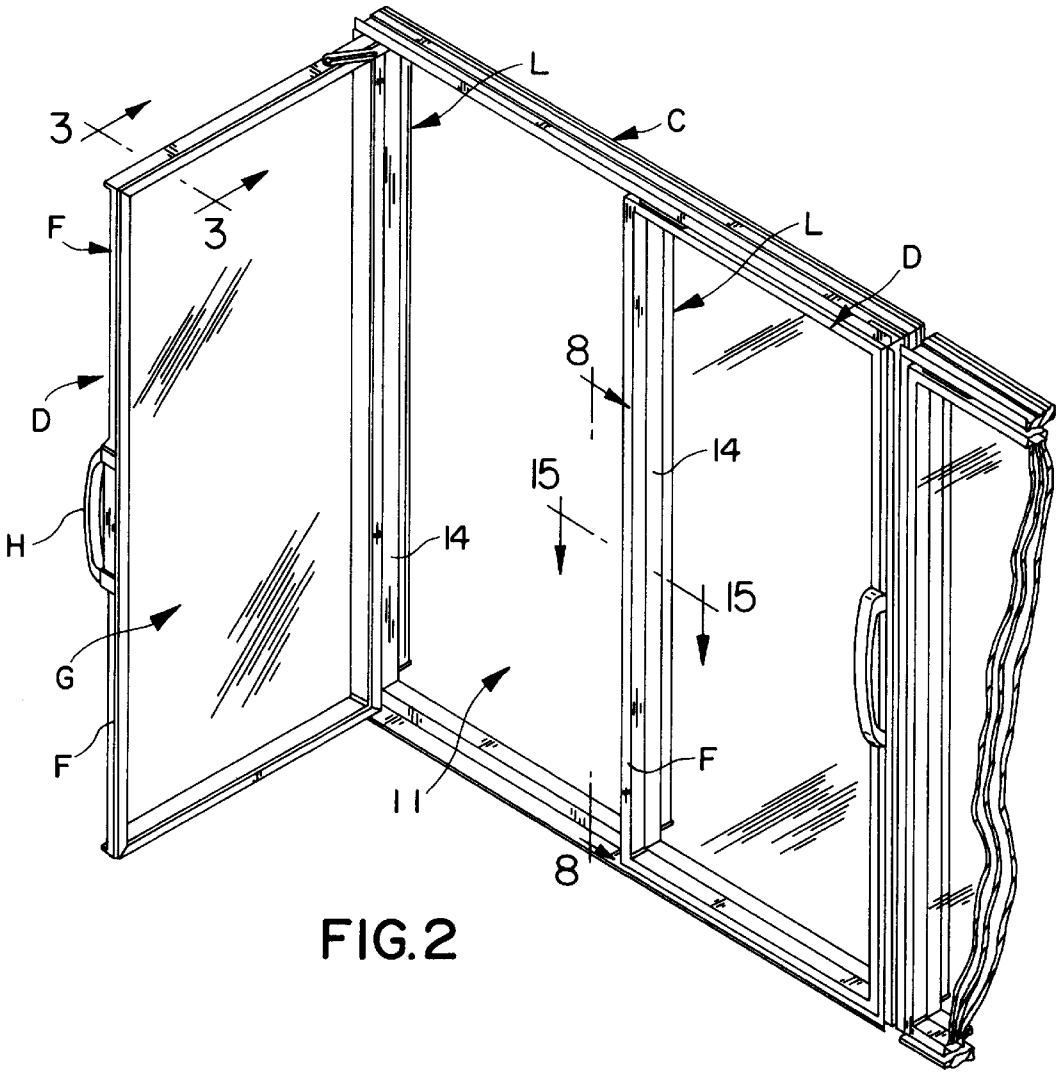
FIG. 2 is a fragmentary perspective view of reach-in doors and associated door casing of the merchandiser.
Figure 15:
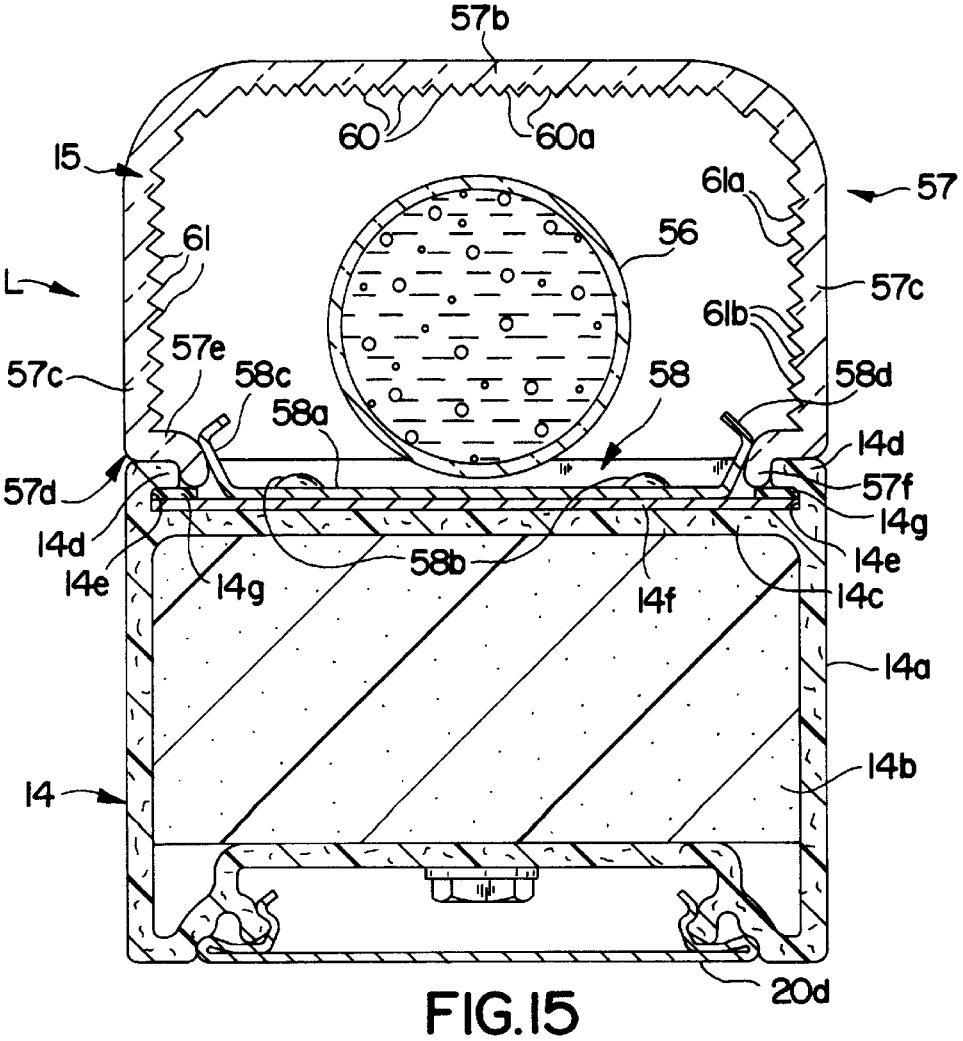
FIG. 15 is a section taken in the plane including line 15—15 of FIG. 2 with the reach-in door removed and showing the lighting means.
Figure 16:
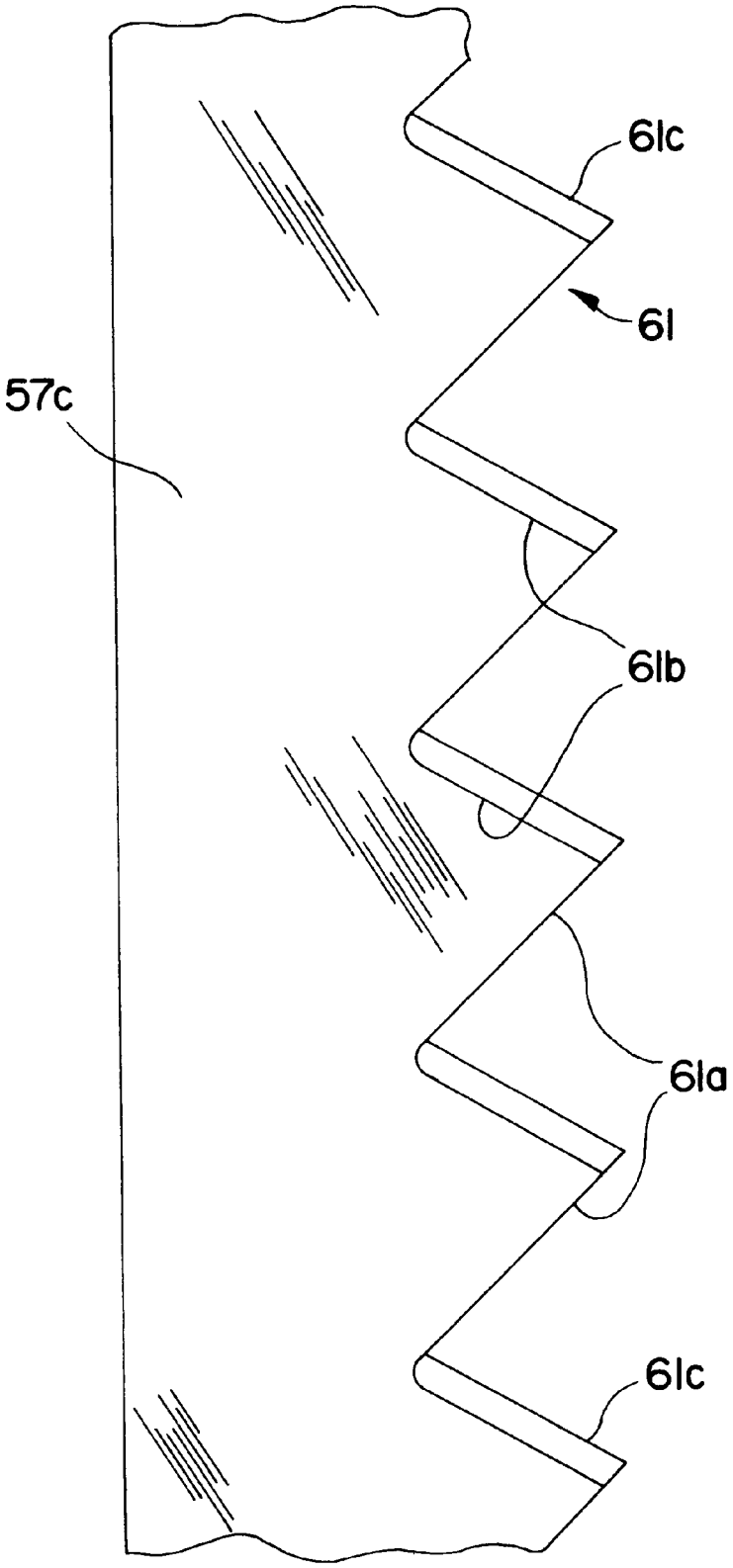
FIG. 16 a is greatly enlarged fragmentary portion of a side wall section of the diffuser of FIG. 15.

The present invention concerns improvements in reach-in merchandisers for medium and low temperature operation, and includes particularly improvements to thermal-type doors for such merchandisers. Referring to the drawings, and in particular to FIG. 1, a low temperature reach-in merchandiser is indicated generally at M for disclosure purposes. The merchandiser has an outer insulated cabinet having a front opening 11 (FIG. 2) defined by a cabinet casing C and closed by doors D hingedly mounted on the casing C. Multiple shelves 12 are selectively provided in the cabinet to hold and display product in the refrigerated interior product zone 13. As shown in FIG. 2, the doors D are opened by handles H to access the refrigerated zone 13 inside the merchandiser where product is held for display. The refrigerated zone 13 is illuminated by lighting L mounted on mullions 14 of the door casing C. These lights L are covered by diffusers 15 (only one of which is shown in FIG. 15) which spread the light within the merchandiser display area 13 as will be described more fully hereinafter.

Figure 3:
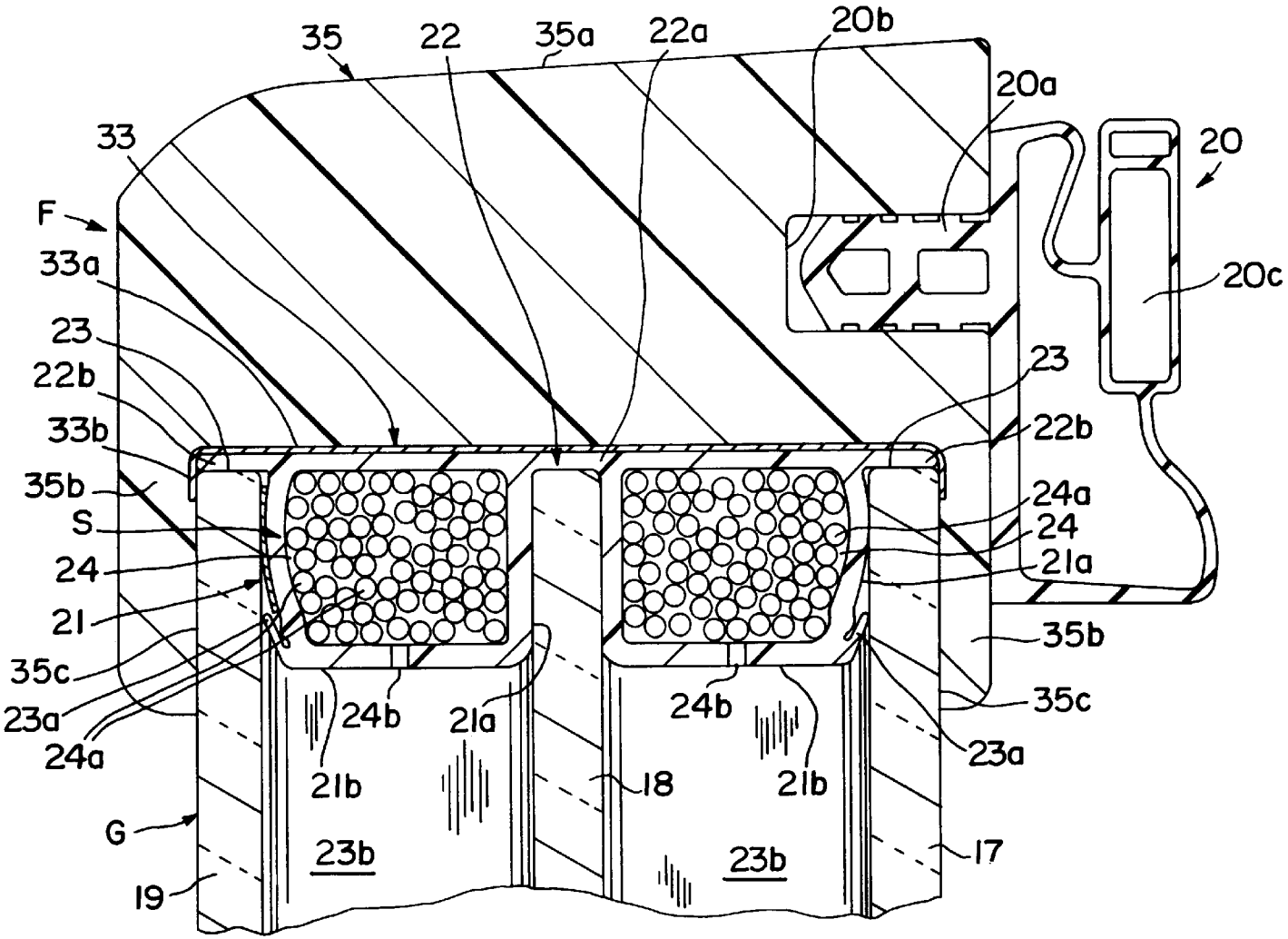
FIG. 3 is a greatly-enlarged fragmentary sectional view of a three lite reach-in door taken in the plane of line 3—3 of FIG. 2.

The reach-in doors D of the present merchandiser are transparent and have a finished molded door frame F of a suitable material, such as a reaction injection molded polyurethane, and do not require a metal frame or covering of any type. In the preferred embodiment, the framing material is polyurethane which has low thermal conductivity for minimizing thermal losses through the door frame, in addition to which it molds with a smooth, hard, glossy or textured surface finish. Referring to FIG. 3, the low temperature door further includes three panes or lites G of glass, namely an inner lite 17, a middle lite 18 and an outer lite 19 that are assembled and held together by the molded frame F. The precise number of lites may be other than described herein without departing from the scope of the present invention, but at least two lites would be used in the door. In an alternate embodiment, the middle lite is made of low-emissivity glass. A flexible magnetic strip holder 20 is attached to the frame F on an inside surface. The strip 20 has a continuous ridge 20*a* which is received in a channel 20*b* extending around the frame. Typical magnetic strips (not shown) are received in a pocket 20*c* of the magnetic strip holder 20. As known, the magnetic strips 20*c* releasably attach to metal plates 20*d* (FIG. 15) on mullions 14 of the door casing C to seal the door D against the casing C when the door is closed.

Figure 4:
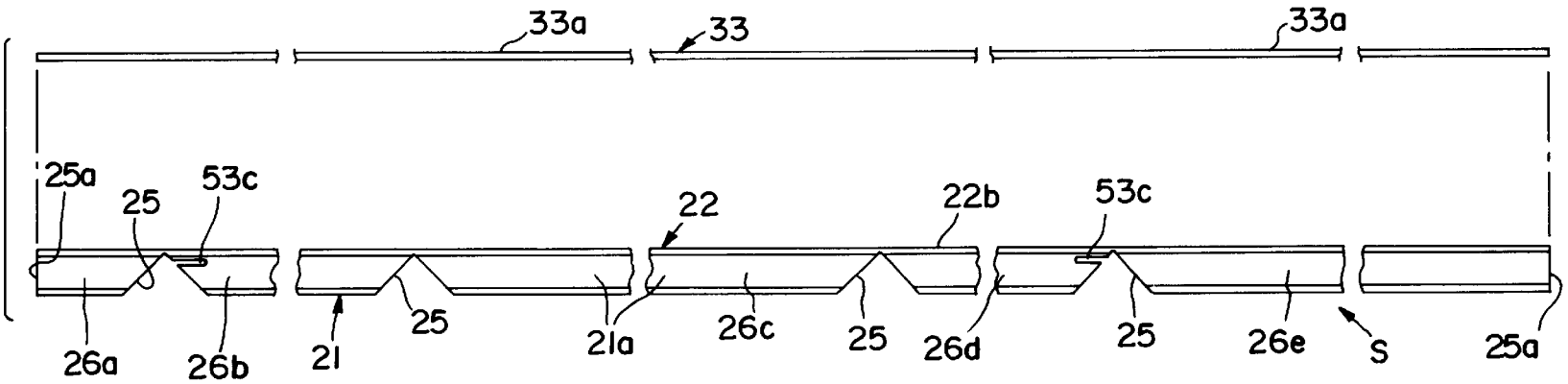
FIG. 4 is a fragmentary edge-on elevational view of a spacer member for the reach-in doors, laid out flat and showing a metal moisture sealing tape exploded above the spacer.

The glass lites are held in parallel spaced apart, generally face-to-face positions relative to each other by a spacer S to form a basic glass panel subassembly preliminary to molding the frame. Referring to FIGS. 3 and 4, the spacer is made of polypropylene, or other suitable material, which has low thermal and electrical conductivity. In a three lite door, two separator or spacer body portions 21 of the spacer S are inwardly disposed between adjacent pairs of the glass lites (i.e. 17,18 and 18,19), and these portions 21 are joined together by an integral, unitary outer wall portion 22. The number of separator portions depends upon the number of glass lites to be spaced by the separator portions. Each separator or spacer body portion 21 has a generally D-shaped or rectangular configuration with spaced side walls 21*a* connected by a free inner wall 21*b* opposite to the outer wall member 22. The side walls 21*a* are engaged in surface contact with respective glass lites (17,18 or 18,19) adjacent to the free edge margins 23 thereof. In addition, sealing lip 23*a* is provided along the juncture of the outward side wall and free wall (21*a*,21*b*) of each spacer body 21 as an additional assurance of continuous sealing engagement of the spacer bodies 21 with the respective inner surfaces 17*a*,19*a* of the outermost glass lites 17,19. Continuous sealing contact of the spacer all the way around the lites is necessary to prevent molded material from encroaching the closed off air spaces 23*b* between adjacent lites during formation of the door frame F. The sealing lips 23*a*, as shown in FIG. 3, are deflected from their resting positions when the separator portions are installed between adjacent glass lites.

The planar-outer wall 22 forms one wall of each spacer body 21 and has a connecting web 22*a* between the spacer bodies and also projects laterally outwardly to form flanges 22*b* at the outer longitudinal edges of the spacer. The laterally projecting flange portions 22*b* abut against the outer peripheral edge margins 23 of the inner and outer lites 17,19 in the door for additional sealing and also to maintain the spacer in position under frame molding pressure. Still referring to FIG. 3, the spacer bodies 21 are hollow (24), but filled with a suitable material for trapping moisture, such as a desiccant 24*a* (e.g., activated alumina). The inner wall 21*b* of each spacer body 21 has suitable holes or slots 24*b* spaced along its length to permit any moisture inside the air spaces 23*b* between adjacent lites to enter the hollow interior 24 and be trapped by the desiccant.

Figure 4A:
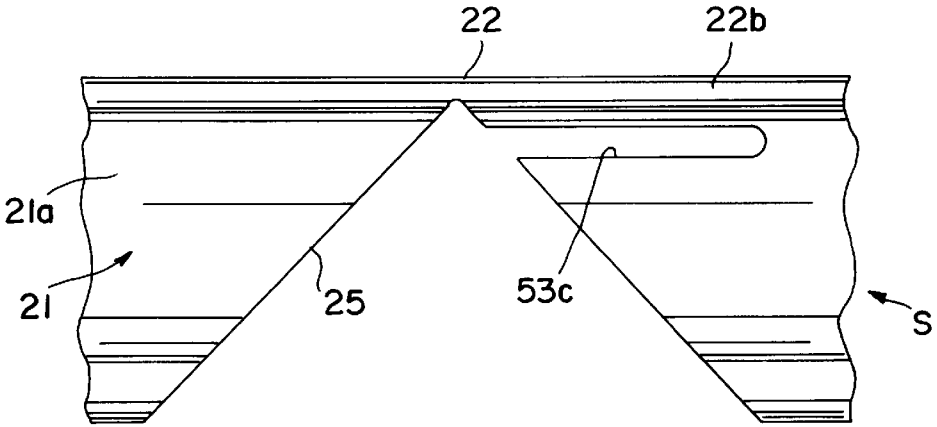
FIG. 4A is an enlarged view of a corner section of the spacer member configured for receiving a crossover electrical connector through the spacer.

Referring to FIGS. 4 and 4A, the spacer S is fabricated as a flat extruded strip with four angle-cut notches 25 being formed in the spacer body 21 at locations corresponding to the four corners of the basic glass panel for the door D. The spacer S forms an outer peripheral covering for the three lites 17, 18, 19 by coming together at the corners (in the fashion of a miter joint) when the spacer is assembled around the lites so that the spacer segments mate and extend continuously along the sides and through the chamfered corners. The spacer S is constructed with five sequential segments identified in FIG. 4 as 26*a*–26*e*, and being interconnected at the angle cuts 25 by the continuous outer wall 22. Clearly, when the spacer S is folded or bent during assembly with the glass lites, the two alternate short segments 26*b* and 26*d* will be in opposed relation and form the short horizontal top and bottom walls of the panel. The long segment 26*c* will define the long vertical wall margin of the panel that will become the outer free (unhinged) handle margin of the door, and the two remaining segments 26*a* and 26*e* at the free ends 25*a* of the strip will close the inner hinged vertical margin of the panel, as now described.

Figure 5A:
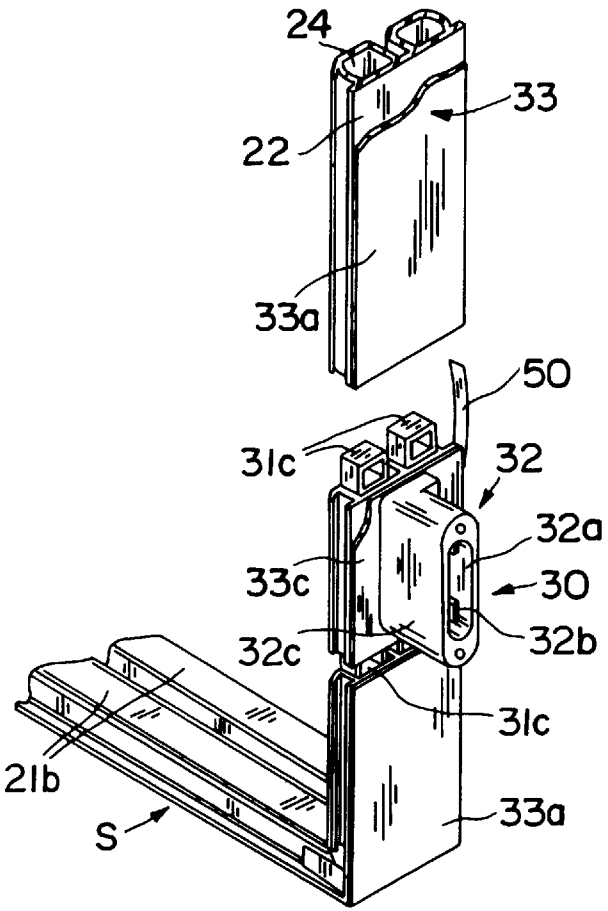
FIG. 5A is a fragmentary perspective view from the opposite side from FIG. 5.
Figure 5:
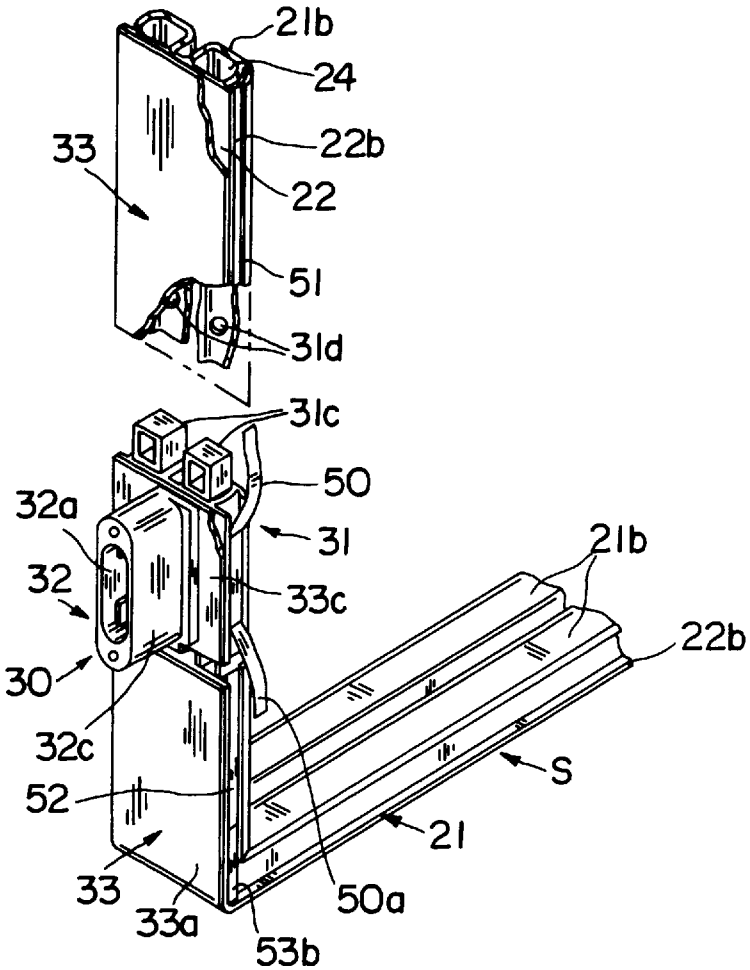
FIG. 5 is a fragmentary perspective view from a corner of the spacer as installed on the glass lites, and partially exploded to illustrate the assembly of the spacer ends by an electrical plug-in and spacer locking key for the door.
Figure 6A:
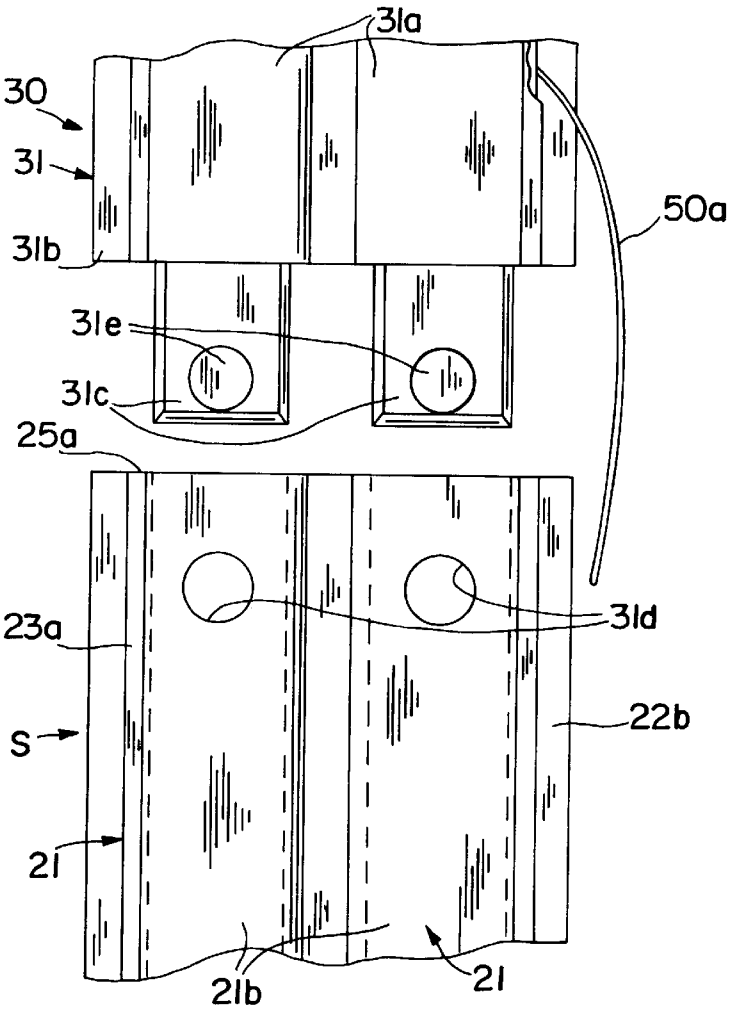
FIG. 6A is a greatly enlarged fragmentary view of the electrical plug-in and spacer locking key taken from the right side of FIG. 6.
Figure 6:
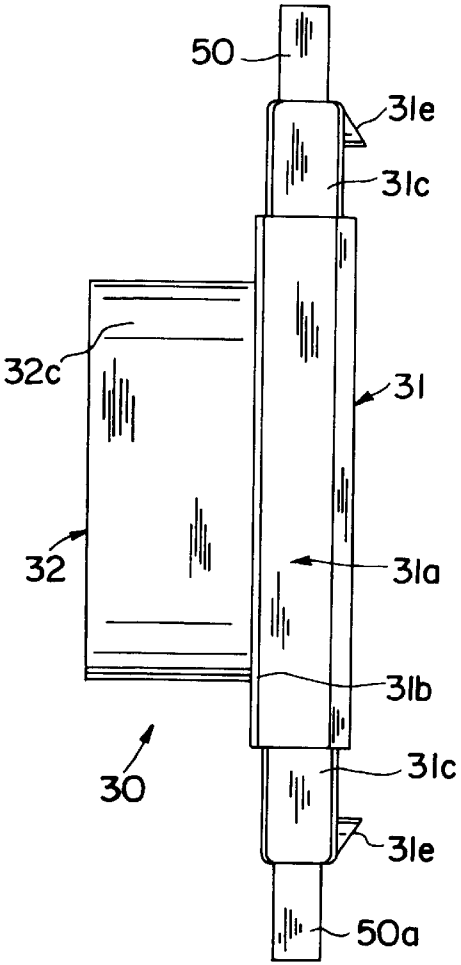
FIG. 6 is a side elevation of the electrical plug-in and spacer locking key of the spacer.

The free ends 25*a* of the spacer strip S are joined together by a unique electrical plug-in and spacer locking key 30, shown best in FIGS. 5, 5A, 6, 6A and 11-13. The key 30 has a main assembly or locking body section 31, and an electrical connector section 32 to be described later. The main body section 31 is constructed and arranged to mate with and join the free ends 25*a* of the spacer S, and it is configured with spaced separator bodies 31*a* and a connecting wall 31*b* with outer flanges to match the configuration of the spacer 21. Connector blocks or keys 31*c* project longitudinally from both ends of the separator bodies 31*a*, and these are sized to fit into the hollow cavities 24 of the spacer bodies 21 (FIGS. 5, 5A and 6A). In addition, the inner wall 21*b* of the spacer bodies 21 have an orifice 31*d* adjacent to their free edge 25*a*, and each key 31*c* has a chamfered locking detent 31*e* to snap lock into these holes 31*d* and form a secure interlock therewith. The spacer S is free of a bonded seal connection to the respective glass lites 17–19 except through the final molded door frame F, as will be described.

An important feature of the invention is the aluminum tape 33 which is applied to the outer surface of the outer wall 22 and flange 22*b*. Referring to FIGS. 3, 4 and 5, the aluminum foil tape 33 has a main body 33*a* that covers the entire outer wall 22 of the spacer S and an edge wrap that extends around the outer flange segments 22*b* and, preferably, onto the adjacent outer surfaces of the inner and outer lites 17,19. Thus, as shown in FIG. 4, the aluminum foil tape 33 may be provided as a unitary one-piece main body sheet 33*a* with integral edge wrap portions (33*b*) or as a series of main body sheets 33*a* corresponding to the five sections 26*a*–26*e* of the spacer strip 21. The foil sheets 33*a* may be applied to cover the outer wall 22 throughout its length so that the spacer is foil covered before it is assembled with the glass lites 17–19. In that event, the width of the aluminum tape would be only slightly greater than the width of the outer wall 22. The tape may wrap around and under the flanges 22*b* and would be in contact with the peripheral edge of the outer lites 17,19 when installed. The electrical plug-in and locking key 30 is also covered with the aluminum tape 33*c*. The aluminum tape 33 provides a non-structural moisture barrier to inhibit significant transfer or migration of water vapor into the spaces 23*b* between the lites for many years. It is to be understood that other materials having the appropriate moisture barrier properties could also be used for the tape, in particular other metals. It is possible to manufacture a door which has no such tape, but the lifetime of the door would be shortened by moisture ingress unless other materials for the spacers or the molded door frame with sufficiently low moisture permeability can be identified.

As indicated, the basic glass panel with assembled lites, spacer and metal foil tape is encased in the outer molded door frame F. As shown in FIG. 3, this frame F has a main body portion 35 that surrounds the periphery of the glass panel subassembly, and has an outer wall margin 35*a* and side walls 35*b* that extend inwardly and capture the outer glass surface margins (35*c*) of the inner and outer lites 17,19.

The reach-in door D is mounted on the door casing C of the refrigerated merchandiser M for swinging motion between a closed position in which the door covers the front opening 11 in the cabinet 10 (center door in FIG. 2), and an open position for access to the refrigerated display zone 13 within the cabinet (left door in FIG. 2). Referring to FIGS. 7, 7A, 9 and 9A, the hinging means for mounting the door D are accommodated during the frame molding process by forming an upper cylindrical opening 38 receiving a metal sleeve or bushing 38*a* and a lower cylindrical opening 39 receiving a sleeve or bushing 39*a*. After completion of molding the frame F around the glass lite subassembly, the upper bushing 38*a* preferably receives a plastic sleeve 38*b* (FIG. 9) in which an upper hinge pin 40 is slidably received for free turning movement so that this hinge pin is free of any fixed connection to the molded frame F. The bushing 38*a* contains a compression spring 40*a* which biases the pin 40 for vertical outward movement relative to the frame F so that the pin projects upwardly to be received into an opening 40*d* in an upper mounting plate 40*b* attached by bolts 40*c* to the door casing C of the merchandiser M (FIG. 9B). The bolts 40*c* are received through respective elongate slots 40*e* located at offset positions in the upper mounting plate 40*b* and are secured into the casing C. The elongation of the slots 40*e* permits the upper mounting plate 40*b*, and hence the position of the hinge pin opening 40*d* to be moved laterally from side to side on the door casing. In this way the pivot axis of the door D can be adjusted for optimum alignment within the casing opening. The pin 40 has a notch 40*f* sized to receive the end of a screwdriver for camming the pin downwardly into the sleeve 38*a*, 38*b* against the bias of the spring 40*a* and out of the opening 40*d* in the upper mounting plate for removing the door D from the merchandiser M.

Figure 7:
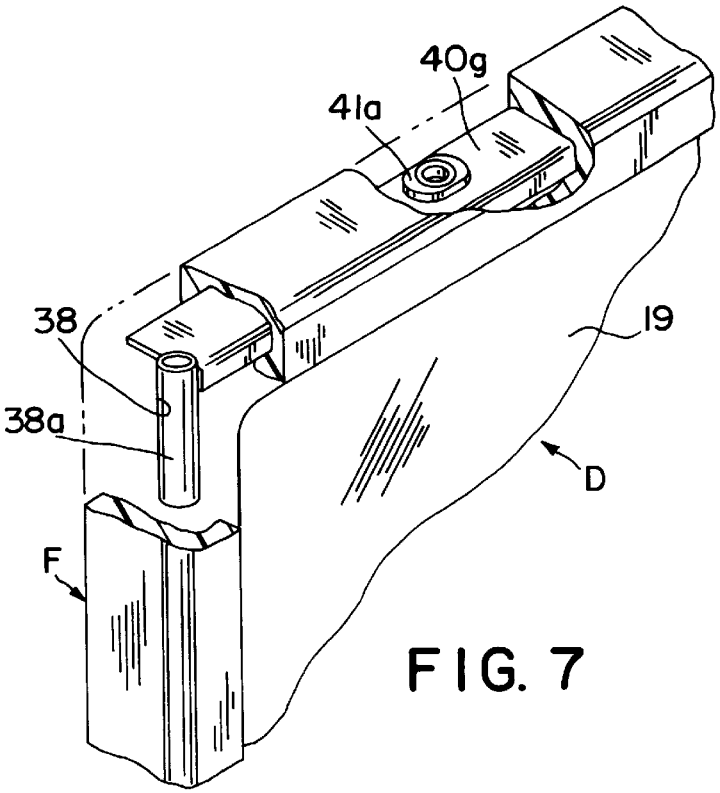
FIG. 7 is a fragmentary perspective view of an upper corner of a reach-in door partly broken away to illustrate an upper hinge reinforcement.

The upper bushing sleeve 38*a* for the upper hinge pin 40 may be part of an upper reinforcing member 40*g* molded into the door frame (FIG. 7). The reinforcing member 40*g* is preferably a shaped metal plate or other suitable high strength structural material and the sleeve 38*a* is secured to it. The use of a reinforcing member 40*g* is to rigidify and strengthen the frame F in the region of the upper door mounting connection and permits forces on the door to be translated and distributed over a wider area of the molded frame F. The member 40*g* also provides a bearing portion (41*a*) to receive a pivot pin 41*b* to connect one end of a hold open bar 41 to the door. The hold open bar 41 limits the maximum angle of opening of the door relative to the merchandiser, and functions to hold the door fully open when needed (e.g., as for stocking the merchandiser). The left-hand door D is shown in its fully open position in FIG. 2. The hold open 41 is pivotally connected to the casing C by a bolt 41*c* at a first end. Typically, the sliding pin is received in a slot near a second end of the hold open and slides along the slot as the door is opened and closed. A narrow neck (not shown) near the end of the slot separates a main portion of the slot from a circular hold open portion (not shown). The hold open has a slit at the end so that the hold open is able to expand to permit the slide pin to pass by the neck and into the hold open portion. The neck prevents the door from closing unless sufficient force is applied to push the pin back through the neck.

Figure 7A:
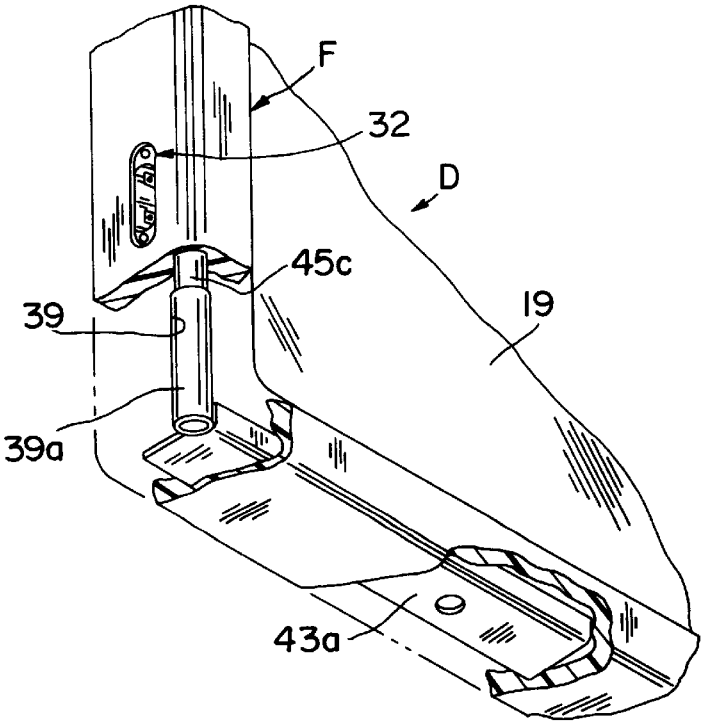
FIG. 7A is a fragmentary perspective view of a lower corner of the reach-in door partly broken away to illustrate a lower hinge reinforcement.
Figure 8:
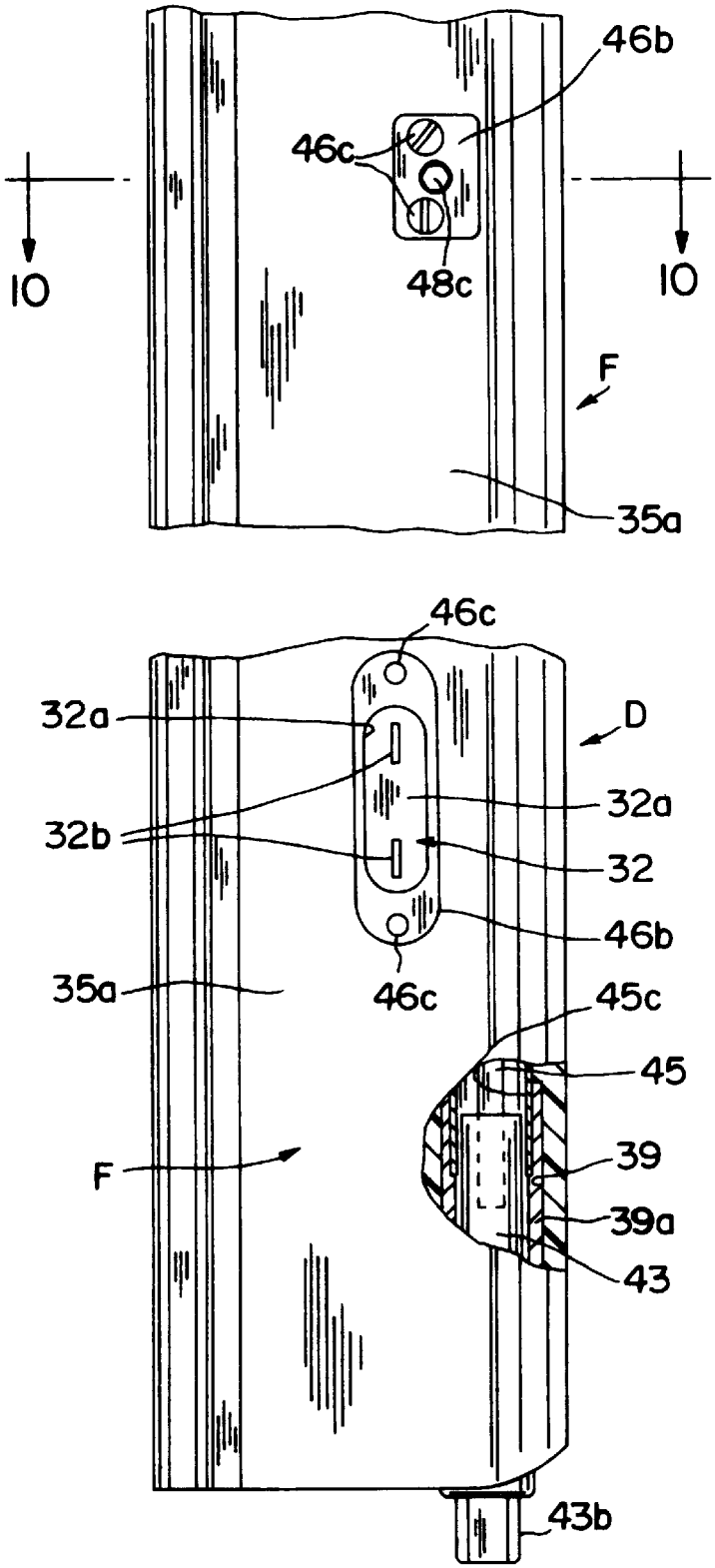
FIG. 8 is a fragmentary elevational view of the hinging margin of the reach-in door with parts broken away to reveal a torsion bar, as referenced by line 8—8 of FIG. 2.
Figure 9:
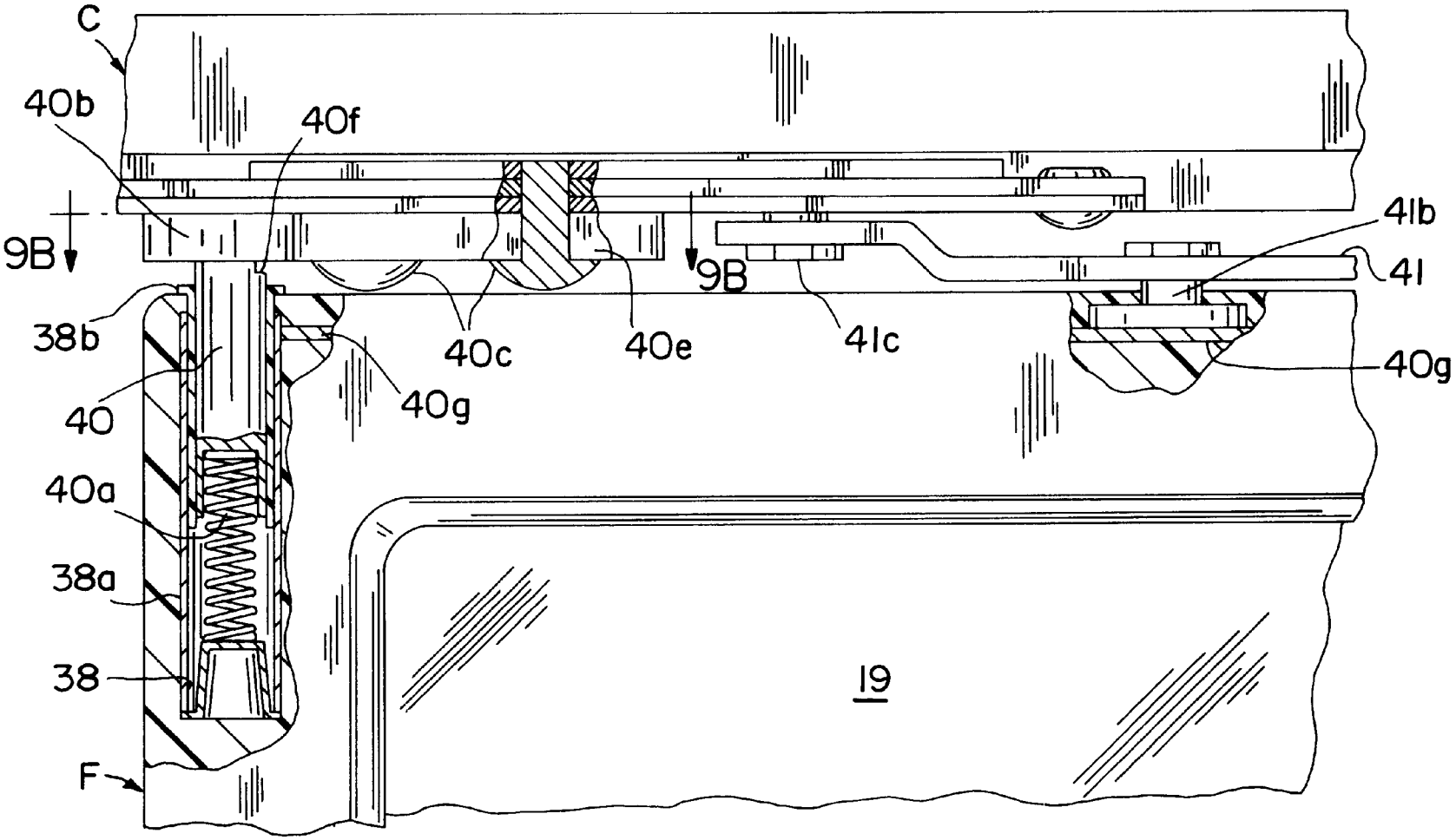
FIG. 9 is a fragmentary elevational view of the upper corner of the reach-in door and door casing, with parts broken away to show details of construction.
Figure 9A:
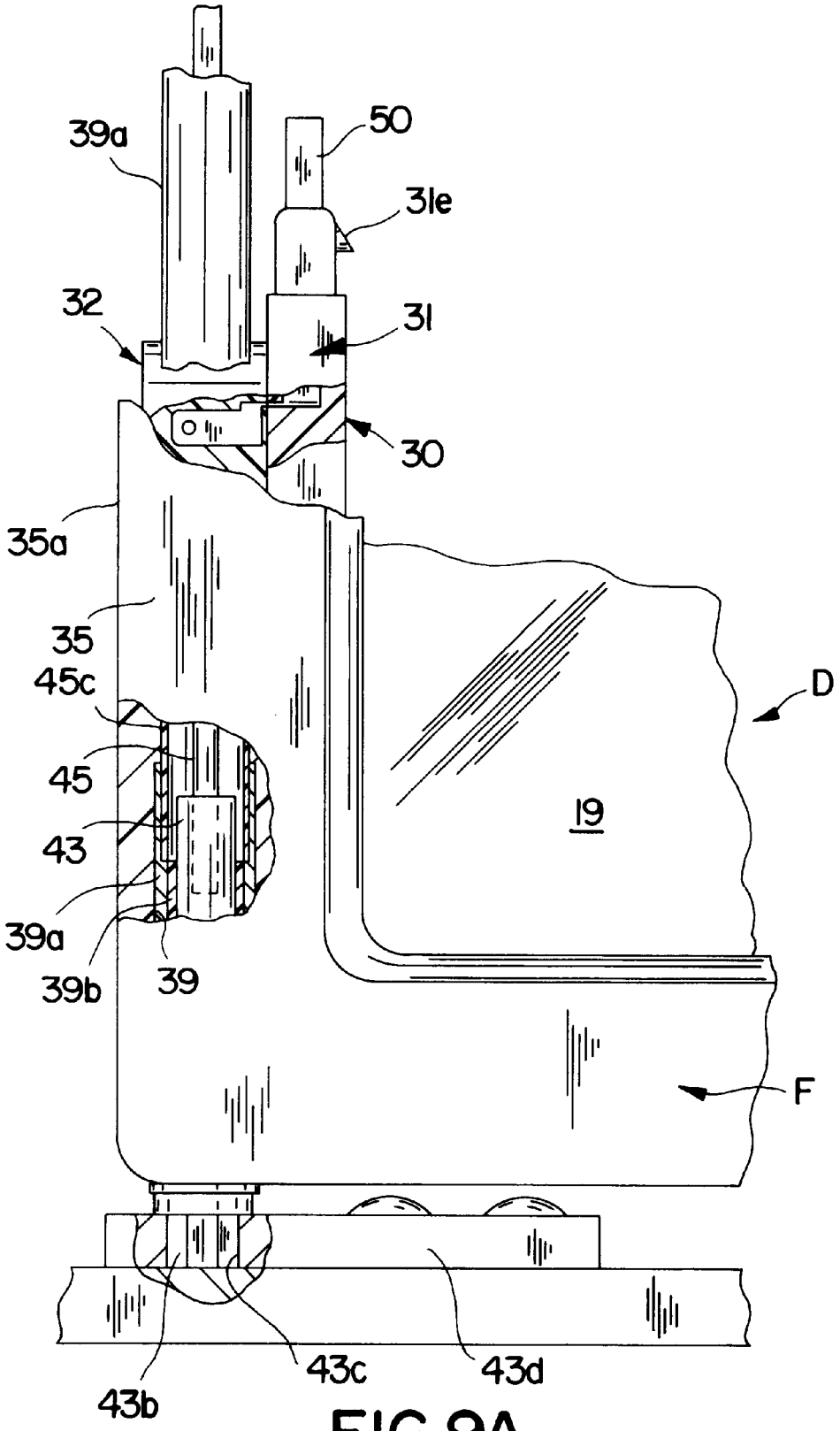
FIG. 9A is a fragmentary elevational view of the lower corner of the reach-in door and door casing, with parts broken away to show details of construction.
Figure 9B:
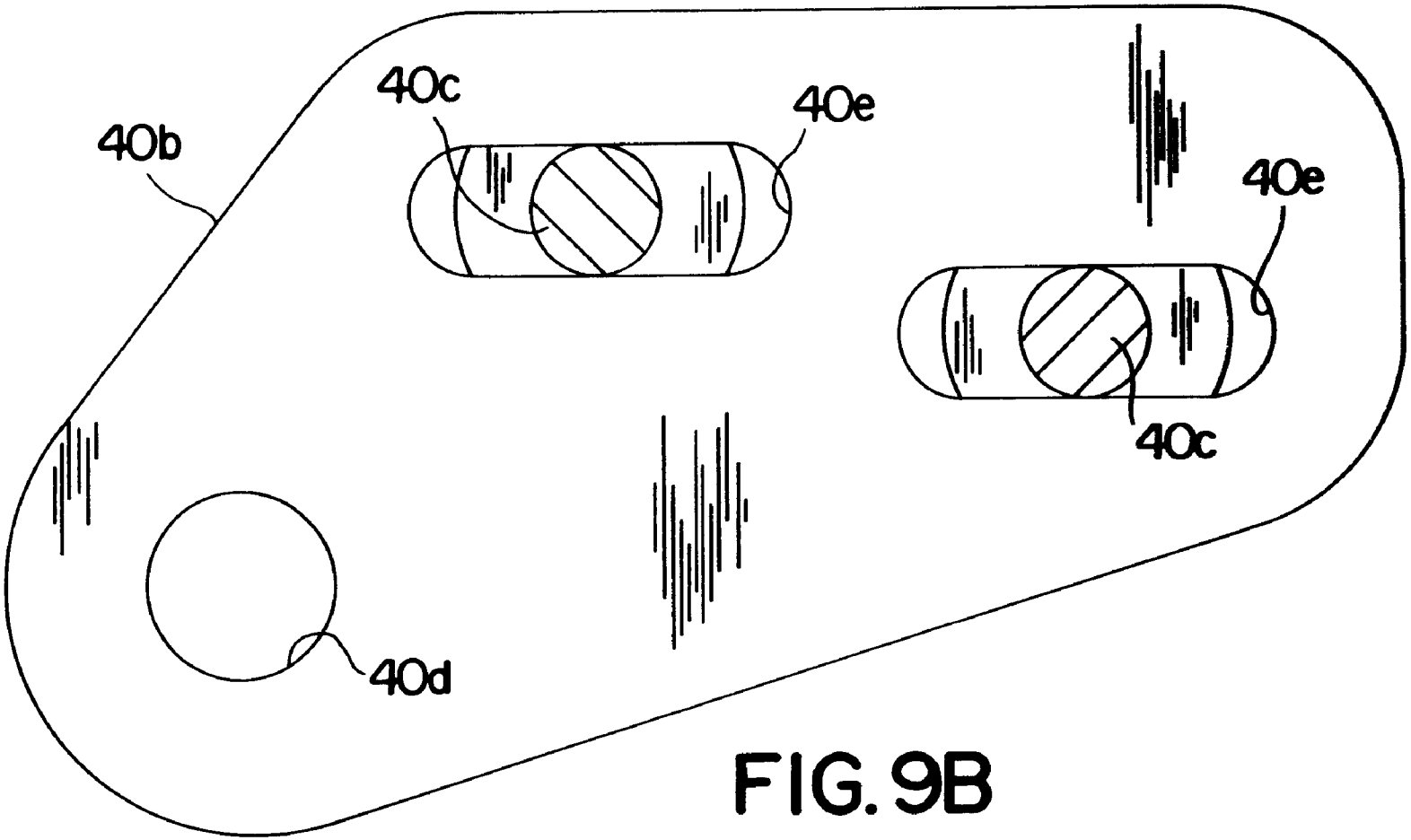
FIG. 9B is a top plan view of a hinge plate as taken along line 9B—9B of FIG. 9.

As shown in FIGS. 7A, 8 and 9A, the lower hinge pin 43 is provided for during the frame molding process by forming the lower cylindrical opening 39 for the bushing 39*a*, and after the molding process a plastic sleeve 39*b* is received in the metal bushing as a bearing for the lower hinge pin 43 which is free of any fixed connection to the molded frame F. The lower bushing 39*a* may be secured to a lower reinforcing member 43*a* (FIG. 7A) for reinforcing the frame F in the door mounting area where the major weight of the door D is translated to the casing C. The reinforcing member 43*a* is preferably molded into the frame F. The lower end 43*b* of the hinge pin projects outwardly below the frame F and is hexagonal (or otherwise shaped) to have a non-rotational fit into a complementary opening 43*c* in a casing bearing plate 43*d* bolted to the case C. Thus, the door D will turn on the lower hinge pin 43 as it is opened and closed while the lower hinge pin is stationary relative to the cabinet casing C.

Figure 10:
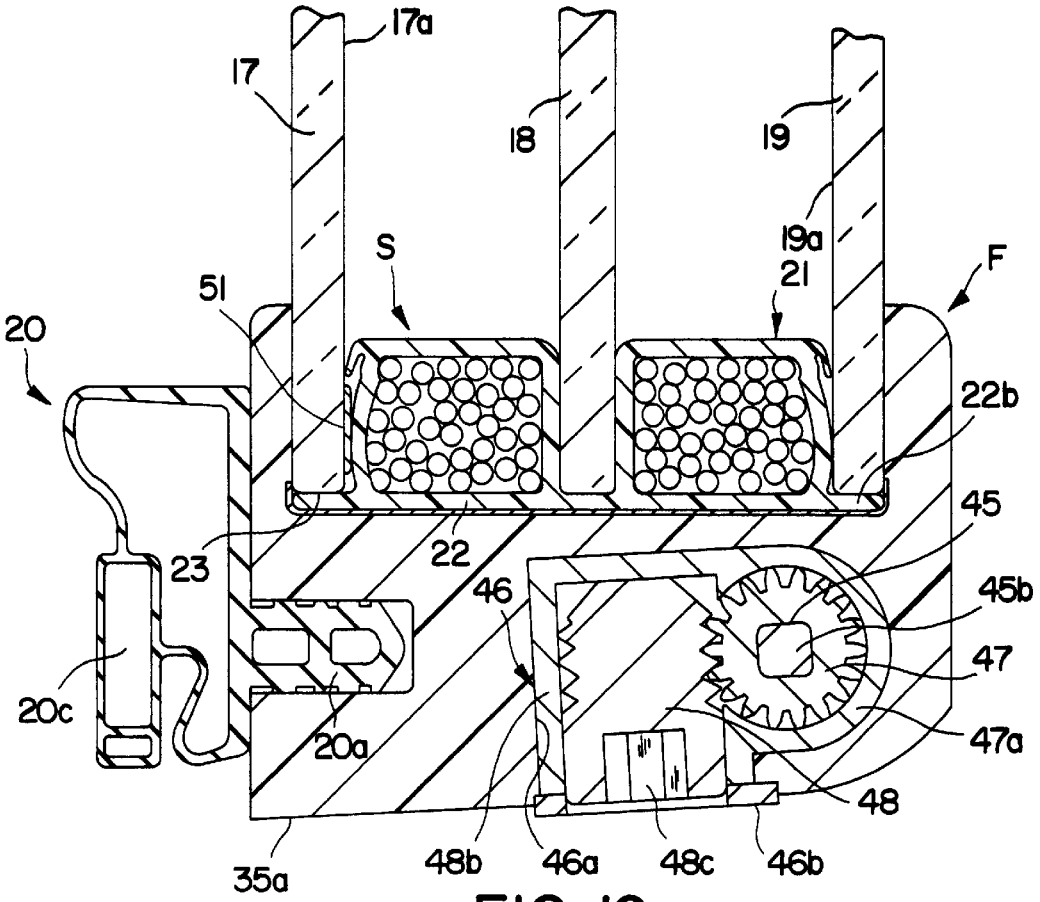
FIG. 10 is a fragmentary sectional view taken in the plane of line 10—10 of FIG. 8 and shows a torsion bar adjustment feature of the door.

A torsion rod 45 is fixedly attached at its lower end to the lower hinge pin 43 whereby the lower end of the torsion rod is held from rotation relative to the lower hinge pin and casing C. The torsion rod 45 is an elongated spring steel member of square cross-section or the like (FIG. 8) which functions to bias the door D toward its closed position. To that end, the upper end 45*b* of the rod 45 is fixed for conjoint pivoting movement with the door. Referring now to FIGS. 8, 9A and 10, the upper end 45*b* of the torsion rod 45 is positioned in torque adjustment housing 46 mounted in a recessed opening 46*a* formed in the hinge margin 35*a* of the molded frame F at a vertically central location of the door (FIG. 8). A cover plate 46*b* has two screws 46*c* to mount the cover plate over the housing 46 in the frame. The upper end of the torsion rod 45 has a spur gear 47 rotatably positioned in an arcuate housing section 47*a*, and the teeth of the spur gear 47 entrain with the helical tooth of a worm gear 48 in the adjacent housing section 48*b*. The worm gear 48 is turned by a recessed Allen head screw 48*c*to turn the spur gear 47 and upper end of torsion rod 45 to torque the rod about its longitudinal axis and either increase or decrease the amount of torsional deflection of the torsion rod. The more the torsion rod is twisted about its axis, the greater latent spring closing force the torsion rod 45 exerts on the door. The provision of the adjustment housing and worm gear in the door provides for easy access to adjust the closing force of the door as necessary. The torsion rod 45 is sheathed within a plastic or like sleeve member 45*c* of the same cross-section as the spur gear housing 47*a* and the lower end of which is nested within the sleeve 39*a*.

Figure 12:
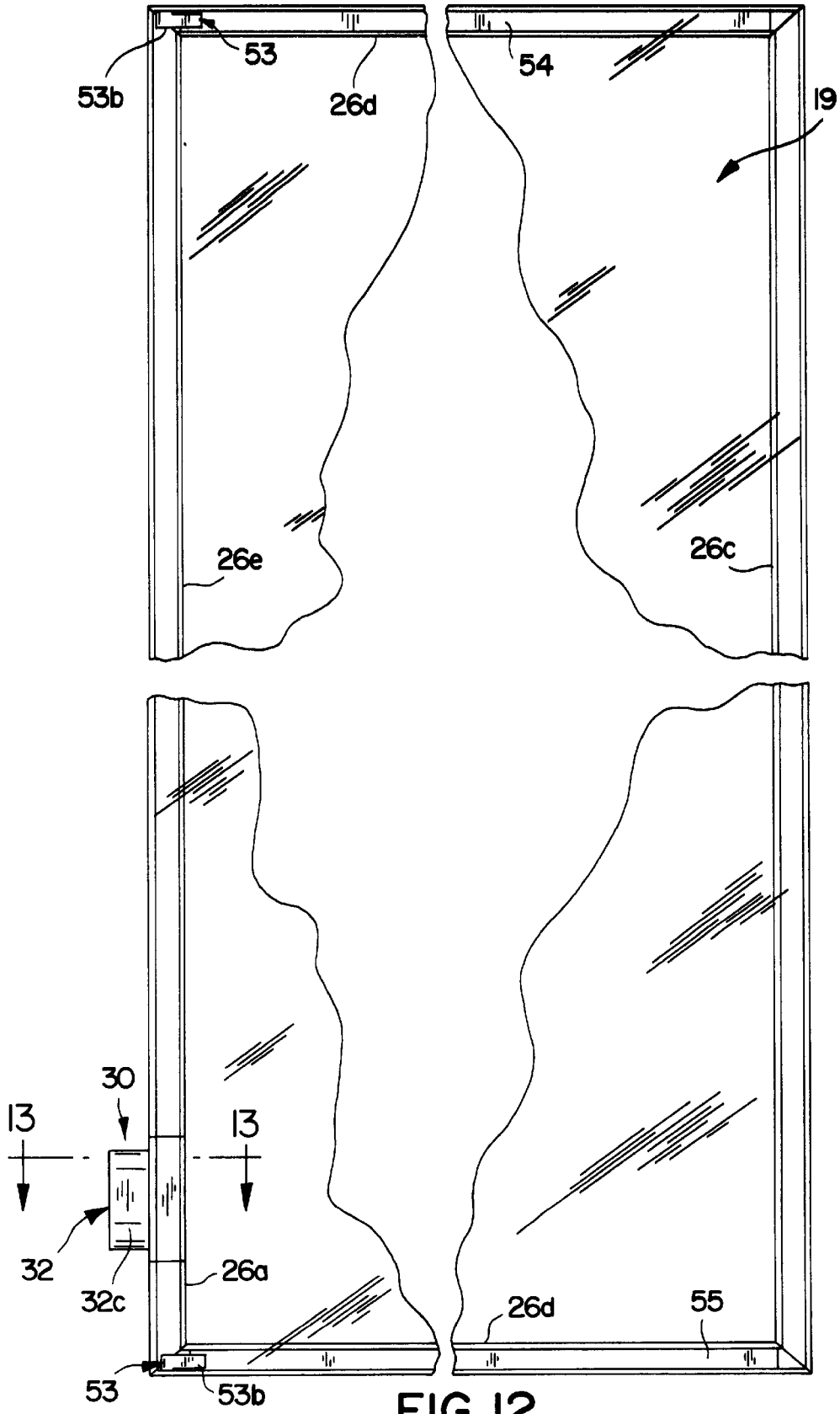
FIG. 12 is a view of the spacer and glass lites from the side opposite to FIG. 11 and illustrates bus bars on the spacer.
Figure 13:
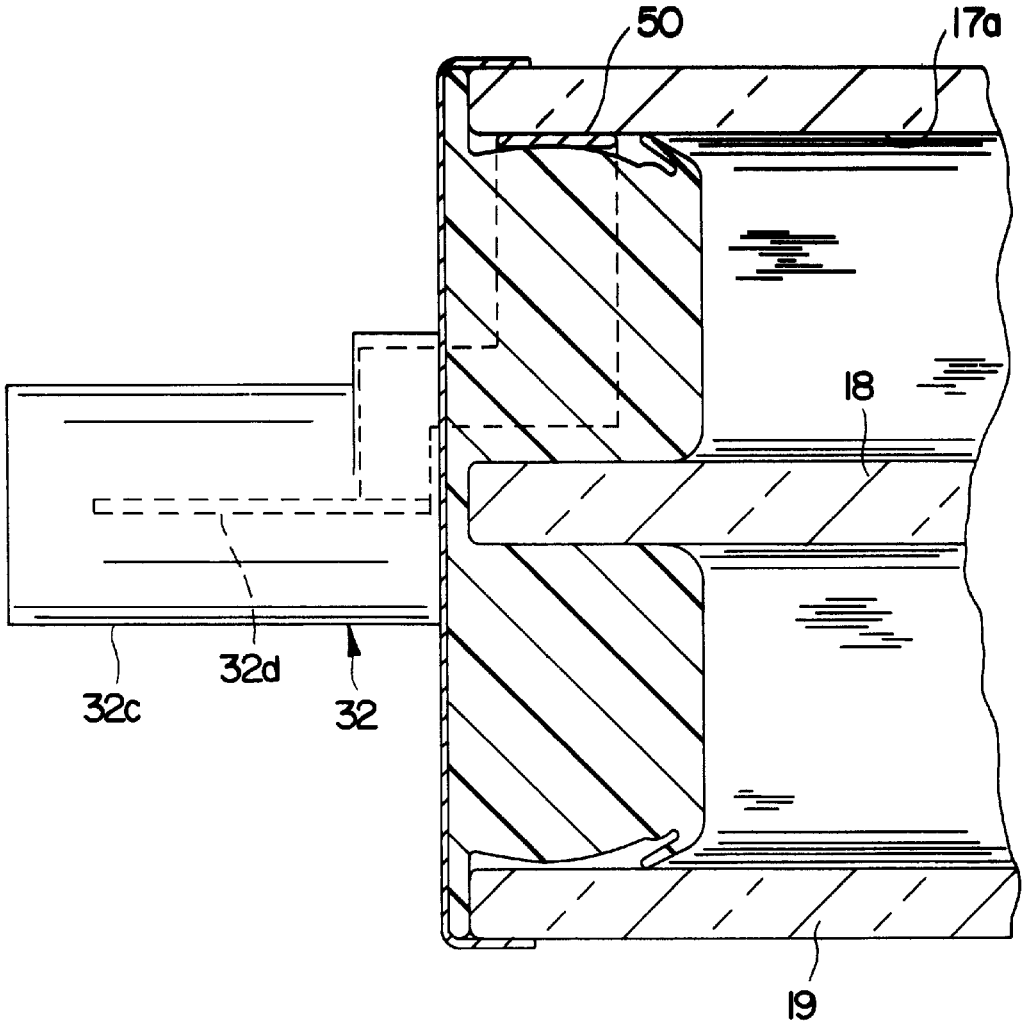
FIG. 13 is a fragmentary sectional view of the spacer taken in the plane including line 13—13 of FIG. 12.

In order to keep the door lites clear of exterior condensation and/or to clear interior condensation after the door has been opened, it is presently preferred that the inner surface 19*a* of the outer lite 19 (FIGS. 12, 13) is heated. Heating is accomplished by applying an electrical potential across a transparent, electrically conducting film on the inner surface 19*a*. Electricity is brought into the door D through the electrical connector section 32 of the plug-in key 30 located on the hinge margin 35*a* of the door frame F. The electrical connector section 32 has a main oval body 32*c* molded into the frame F and having a female socket 32*a* that receives a typical male connector plug (not shown) from the merchandiser casing C. Electrical contacts of the male connector mate with prongs 32*b* located in the socket recess so that the door is plugged into the merchandiser as a source of electrical power (FIGS. 8, 13). The prongs are made of a suitable electrically conducting material, such as bronze. As shown in FIGS. 5, 5A, 6, 6A, 9 and 11, the electrical heating means for the door lite includes spring leaf contacts 50,50*a* which protrude from the inner locking body side of the key and extend in opposite directions. Preferably, these leaf contacts are made of a softer material, such as copper, and are connected to the respective prongs 32*b* through the inside of the key (FIG. 13). The leaf contacts may be made of the other electrically conductive materials and may be formed as one piece with the prongs.

Figure 11:
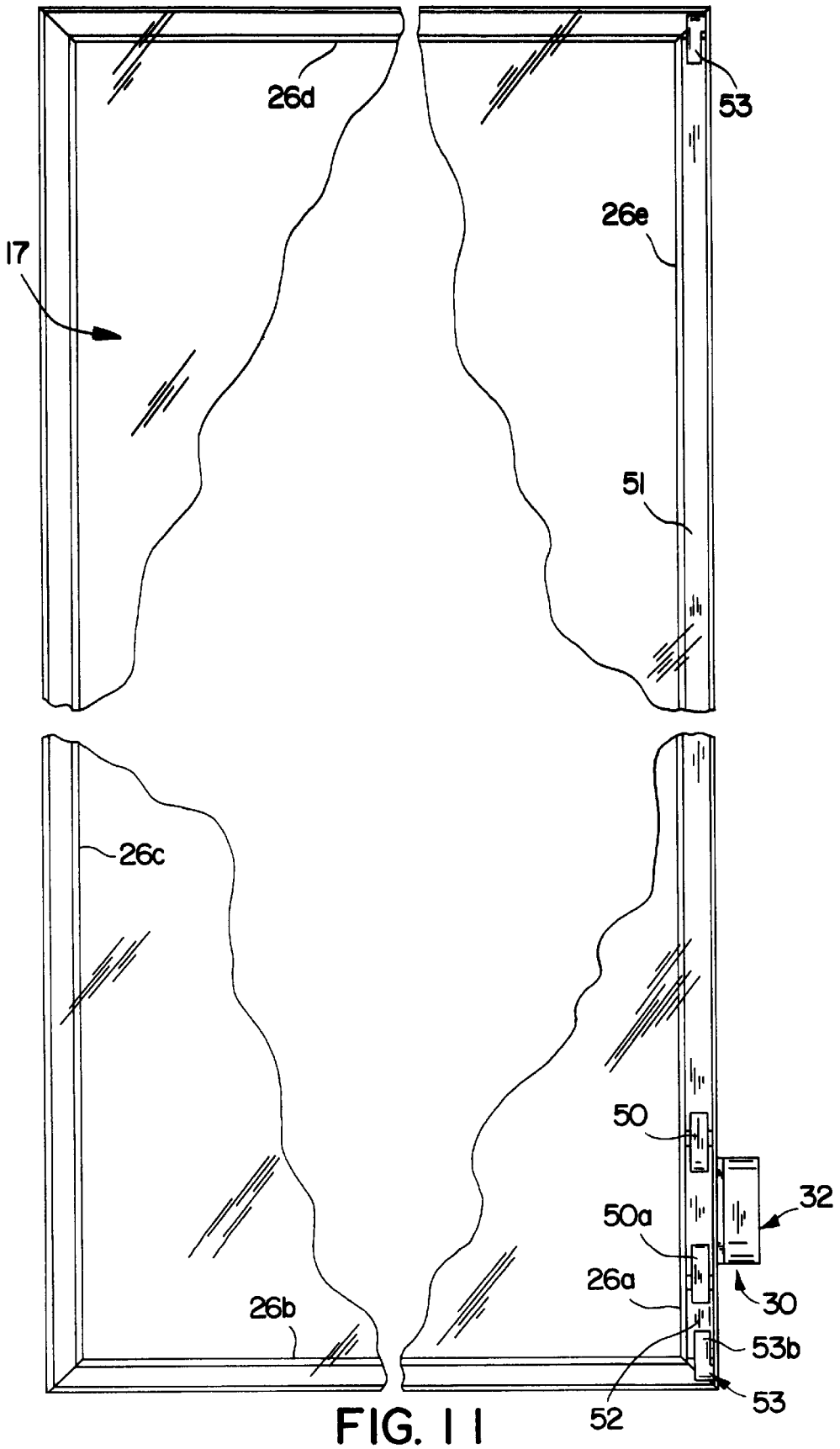
FIG. 11 is a view of the spacer as assembled around the glass lites, and illustrates electrical conductors on the spacer.

The leaf contacts 50,50*a* are pressed against the side of the inner spacer body 21 of the spacer by the inner lite 17, and against conductors 51,52 received in a groove on the side of the spacer body. The conductors are a copper foil in the preferred embodiment, but may be of another electrically conductive material. As shown in FIG. 11, a first of the conductors 51 extends from adjacent the electrical plug-in and spacer locking key 30 upwardly to the upper corner of the door frame, and a second of the conductors 52 extends from adjacent the electrical key downwardly to the lower corner of the door frame. The electrical conductors 51,52 are sandwiched between the electrically insulating inner surface 17*a* of the inner glass lite and the electrically insulating spacer. The molded frame F extends onto the inner lite 17 a distance greater than the depth of insertion of the spacer body 21 between the inner lite 17 and middle lite 18 so that the spacer is covered. Accordingly, the conductor is also covered by the molded frame which isolates it from sight and touch of the customer so that even if the outer lite should break, the conductor is still shielded between the frame and spacer from incidental contact.

Figure 14:
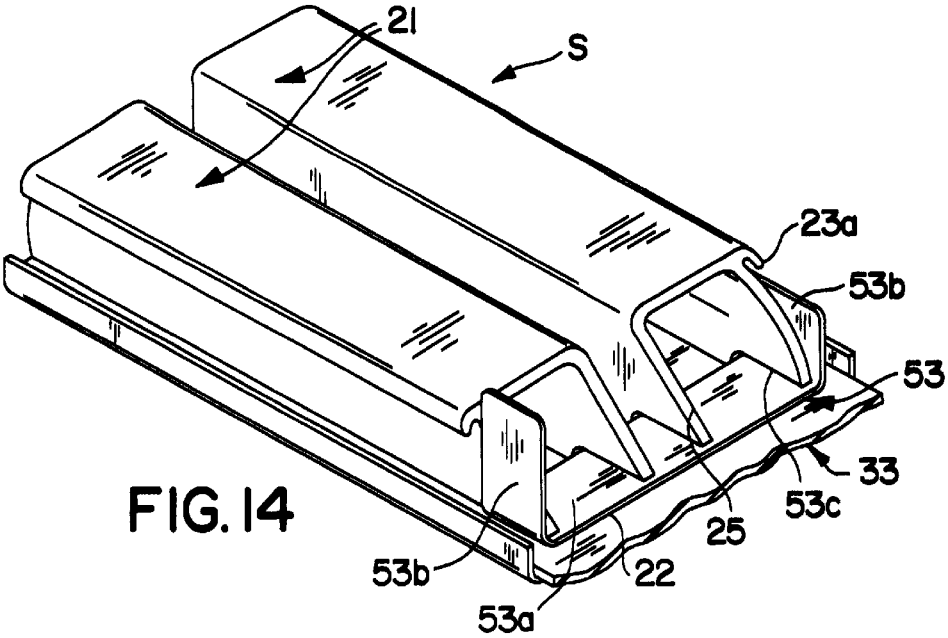
FIG. 14 is a fragmentary perspective view of a bottom corner portion of the spacer and illustrates a crossover connector.

At the upper and lower corners, respective crossover connectors 53 electrically connect the first conductor 51 to an upper bus bar 54 and the second conductor 52 to a lower bus bar 55 (FIG. 14). Referring to FIG. 12, the upper bus bar 54 extends between the spacer body 21 and the inner surface 19*a* of the outer lite 19 across the top of the door. Similarly, the lower bus bar 55 extends between the spacer body 21 and the inner surface 19*a* of the outer lite 19 across the bottom of the door. Each bus bar is a copper foil and is in contact with the conductive film on the inner surface of the outer lite so that the bus bars are able to apply an electrical potential between the top and bottom of the inner surface. The compressive force applied by the molded frame F, when formed, is sufficient to secure the electrical engagement of the bus bars 54,55 with the film on the outer lite 19. It is noted that the bus bars are screened from view and protected from incidental contact in the event the outer lite breaks.

As shown in FIG. 14, the crossover connectors 53 include a crosspiece 53*a* and end tabs 53*b* which are oriented at right angles to the crosspiece. The end tab 53*b* on one side of the spacer contacts the second conductor 52 running down from the electrical plug-in 30 and connects across the IG unit to the other end tab engaging the lower bus bar 55 (FIG. 12). The crosspiece 53*a* extends through the slots 53*c* formed at the notches 25 of the spacers (FIG. 4) to transfer the electricity across the insulated space between the inner lite 17 to the lower bus bar 55 connected with the electrically conductive film on the inner surface 19*a* of the outer lite 19. The crosspiece 53 at the top of the door similarly connects the conductor 51 on one side of the panel with the bus bar 54 on the outer lite. Thus, the crosspieces do not interfere with the right angle geometry and close fit of the spacers at the corners with the glass lites.

In another embodiment of the present invention, only the inner surface 17*a* of the inner lite 17 would be heated and thus the electrically conductive film would be applied to that surface (17*a*). In that event, the arrangement of the conductors 51,52 and bus bars 54,55 would be reversed from that described above and shown in the drawings (particularly FIGS. 11 and 12). The conductors 51,52 would be disposed between the outer lite 19 and the spacer body 21 adjacent the outer lite, and the bus bars 54,55 would be disposed between the inner lite 17 and the spacer body adjacent thereto. In this embodiment, at least the middle lite 18 and possibly the outer lite would have a low emissivity material coating to further reduce heat transfer through the glass. In addition, the space between adjacent lites may be filled with a dry gas, such as Argon or Krypton, having low thermal conductivity. The increased thermal resistance of this arrangement reduces concern over external condensation. Thus, the heated surface is shifted to the inside lite where it is still needed for door clearing. In this embodiment, only about half the power is required to clear the inner surface in a commercially acceptable time.

The merchandiser M is internally lighted to permit product held on the shelves 12 in the product zone 13 to be viewed through the transparent doors D. The lighting means L comprise fluorescent lamps 56 mounted in a vertical orientation on the mullions 14 of the merchandiser door casing C in a conventional fashion. As shown in FIG. 15, the mullions include a hollow structural member 14*a* substantially filled by an insulating foam 14*b*. The structural member 14*a* is preferably formed of a non-metallic material. The metal plate 20*d* is attached to the outside of the mullion 14 for engagement by the magnetic strip 20 to latch or hold the door D onto the casing C. The fluorescent lamp 56 is encased by a generally C-shaped channel diffuser 57 and is removably attached to the mullion by leaf spring clips 58.

The mullion 14 is constructed on the inner side with a base wall 14*c* and opposed in-turned ears 14*d* project inwardly therefrom to define channels 14e receiving a reflective plate 14*f* captured by the ears 14*d*. A gasket member 14*g* extending lengthwise of the mullion 14 on each side is also provided. The spring clips 58 are vertically spaced apart at predetermined places. The spring clips 58 have a base wall 58*a* that engages against the reflector plate 14*f* and is held in place by metal screws 58*b* or the like. The clips 58 also have angled side walls 58*c* spaced from the mullion ears 14*d* at the resilient gasket members 14*g*, and end walls 58*d* of the clips form in-turned camming surfaces for the clip. The diffuser 57 has a main or base light transmitting wall 57*b* and opposed side walls 57*c* forming the open channel configuration. The elongate free edge margins 57*d* of the side walls have inwardly turned flanges 57*e* with curved outer lips 57*f*. These curved margins 57*d* form ridges along the opposing longitudinal sides which seat against the opposed in-turned ears 14*d*. The diffuser 57 is assembled on the mullion 14 by pressing the free outer lips 57*f* against the camming surfaces 58*d* to spring the clip walls 58*c* inwardly and seat the inward flanges 57*e* on the mullion ears with the gasket lips 57*f* pressing against the gaskets 14*g*. In short, the leaf spring 58 clamps the diffuser against the mullion ears, but the diffuser 57 (and light) can be pulled away against the bias of the leaf spring to remove the light lamp 56 from the mullion 14.

The main wall 57*b* of the diffuser 57 is internally faceted, at 60, like a conventional diffuser so that light emanating from the lamp is spread horizontally within the refrigerated zone 13 to more evenly light the product throughout the vertical length of the lamp 56. The serrated facets 60 on the inner main wall surface 57*b* of the diffuser have uniform isosceles wall surfaces 60*a* arranged for equal angular refraction of light through the diffuser wall 57*b*. However, side walls 57*c* of the diffuser are constructed with serrated facets 61 of different surface area, one surface 61*a* being longer than the other surface 61*b* so that the facets 61 are more jagged or uneven thereby to enhance the bending of the light inwardly into the display zone 13. The longer surfaces 61*a* of each facet 61 are unobstructed to permit the passage of direct and reflected light to be refracted through the diffuser 57 toward the display area. In other words, the arrangement of the jagged facets 61 causes light passing through the longer surfaces 61*a* to be bent in the direction of the interior of the merchandiser.

A feature of the invention is to control the light which would tend to pass through the shorter surfaces 61*b* and be refracted in a direction outwardly of the merchandiser through the door D. In the past such light concentration at the diffuser sides would have been observed as a glare phenomena to the customer approaching the merchandiser. In the present invention the shorter diffuser surfaces 61*b* are selectively covered with an opaque material 61*c* or otherwise masked so that light cannot pass through these control surfaces. Thus, the light that would ordinarily be refracted toward the doors D is blocked so as to reduce glare and provide more even interior lighting of the product area.

Method for Making the Reach-In Door

The reach-in door of the present invention is assembled by first providing the various component parts, including the outer 19, middle 18 and inner 17 glass lites, the spacer S, electrical plug and spacer locking key 30, and torsion rod adjustment assembly (38*a*,38*b*,39*a*,45,45*c*,46,47,48) and reinforcing members 40*g*,43*a*. The inner surface of the outer lite 19 is formed with a transparent, partially electrically .conductive film. The lites are washed immediately prior to assembly, and the edge surfaces of the inner and outer lites 17,19 (which will be contacted by the molded frame material) are primed with a chemical adhesion promoter to promote bonding of the molded frame material (e.g., polyurethane) to the glass.

The spacer S is extruded from a polymer or other suitable material having an appropriate Underwriter's Laboratories rating. The polymer material selected should have thermal and electrical insulating properties and produce minimal chemical fogging of the glass surfaces. The spacer strip is notched (25) and slotted (53*c*) and the hollow spacer bodies 21 are filled, as needed, with the desiccant 24*a*. The open free ends 25*a* of the spacer S are plugged to retain the desiccant. The copper foil bus bars 54,55 are adhered to the sides of the spacer segments 26*d*,26*b* which will ultimately extend across the top and bottom of the door in contact with the inner surface 19*a* of the outer lite 19. It is also permissible to adhere these bus bars directly to the glass, although assembly is believed to be simplified by providing them on the spacer. The copper foil conductors 51,52 are also adhered to the side of the spacer segments 26*a*,26*e* which will engage the inner surface 17*a* of the inner lite 17 along the hinged edge margin of the door D. The crossover connectors 53 are also installed in the slots 53*c* at the upper and lower corners to make electrical connection between the conductors 51,52 and respective bus bars 54,55.

In a three-lite panel, the spacer S is then folded or wrapped around the middle glass lite 18, the marginal edge of which is received in the groove between the opposed side walls 21*a* of the spacer bodies 21 and abutting against the connecting web 22*a* of the outer wall 22. The spacer is constructed and arranged so that the corners of the glass correspond to the notches or chamfers 25 in the spacer to permit the spacer to be bent 90° and fit together and mate in the manner of a mitered corner, so that they extend substantially uninterruptedly through the corners. The spacer is constructed and arranged such that it extends nearly the entire distance around the perimeter of the middle lite 18. However, the free ends 25*a* of spacer sections 26*a*,26*e* will be spaced apart to permit the interlocking connection by the locking plugs 31*c* of key 31 on like mating assembly . These plug-in tabs 31*c* are inserted into the hollow openings 24 at the opposing ends 25*a* of the spacer, and the detents 31*e* on the keys 31*c* snap into the openings 31*d* in the spacer for locking engagement.

The inner and outer lites 17,19 are then inserted into the initial unit formed by the spacer S and middle lite 18. The inner and outer lites fit against respective spacer bodies 21 and the outer marginal edges 23 of these lites are received under the flanges 22*b* of the spacer. If the tape 33 is not pre-applied to the spacer wall 22, then the aluminum tape 33 is now applied to the respective side stretches of the wall 22 and turned to extend over slightly (e.g., approximately 0.10 inches) onto the outer lite surfaces. The taping step is done to make certain that the spacers are covered around the lites especially at the corners to prevent intrusion of frame molding material between the lites. Preapplication of aluminum foil tape can be eliminated in favor of a taping step after the spacer has been applied to capture the glass lites and form the basic IG unit. In that event, the taping would be extended over the entire length of the spacer, and especially at the corners. In addition, tape is placed around the electrical plug-in and spacer locking key 30. A portion of the tape 33 has been broken away in FIGS. 5 and 5A and 12 to illustrate its presence. In addition, a strand or rope of sealant (e.g., polyisobutylene) may be wrapped around the socket 32*a* of the electrical key 32 to promote sealing between the electrical key and the molded frame material.

The captured spacer and glass lites subassembly is placed into a mold (not shown) for forming the door frame. In addition, the reinforcing members 40*g* ,43*a*, including the hinge pin bushings 38*a*,39*a* are positioned in the mold, as is the torque adjustment housing 46. The bushing 39*a* associated with the lower hinge pin 43 is accompanied by a sleeve 45*c* which houses the torsion rod 45 below the torque adjustment housing 46. Suitable bushings (not shown) are placed in the mold for the door handle H, and other suitable fixtures or disposable members are provided to form other openings and spaces for reducing space or otherwise as needed. The mold is closed and the molded frame F is formed by introducing one or more shots of liquid polyurethane frame material or the like into the mold cavity. The desiccant in the spacer bodies 21 may in certain circumstances provide structural integrity for the spacer bodies of the spacer during molding. The construction and arrangement of parts within the mold is designed to prevent the incursion of door frame molding material to circumvent the spacer and enter the spaces between the lites 17,18,19. Such incursion would produce an aesthetically unacceptable product. The sealing lips 21*c* on the spacer bodies also provide protection against door frame material moving past the spacer, tending to block further movement of any material which manages to enter under the flange 22*b* between the lites and the spacer body. A period is allowed for demolding and the mold is opened. Known procedures may be used to provide protection for the molded frame against ultraviolet degradation.

The interior of the captured glass panel subassembly (i.e. the spaces between adjacent lites 17,18 and 19) is sealed by bonding of the molded frame F around and onto the inner and outer lites 17,19. The "air" spaces between the panes of glass may be selectively filled with an a dry gas, such as Argon or Krypton having low thermal conductivity. The torsion rod 45 with spur gear 47 (and lower hinge pin 43) are slid into the sleeve member 45*c* and housing chamber 47*a* with the sleeve 39*b* being positioned inside the bushing 39*a*. The torque adjustment worm gear 48 is mounted in the torque adjustment housing 46 and is meshed with the spur gear 47*b* on the upper end of the torsion rod, and the cover plate 46*b* is secured. The sleeve 38*b* is inserted in the upper bushing 38*a*, and the spring 40*a* and upper hinge pin 40 are now received in the sleeve 38*b* and bushing 38*a* at the top of the door. The handle H is also attached to the door, the magnetic strip holder 20 (including the magnetic strip) is inserted into the groove 20*b* and other hardware applied. It is to be understood that fewer than all of the foregoing steps may occur at one manufacturing location. For instance, the spacer could readily be produced at a remote location and shipped to the final assembly site.

The present reach-in merchandiser M and door D therefor has excellent thermal insulation and product display qualities, and achieves the other objects set out for the invention. Moreover, assembly of the door is carried out with a limited number of steps. It is to be understood that the foregoing description and accompanying drawing have been given only by way of illustration and example, and that changes and modifications in the present disclosure, which will be readily apparent to all skilled in the art, are contemplated as within the scope of the present invention, which is limited only by the scope of the appended claims.

What is claimed is:

1. A transparent door that, in use, is movably mounted to provide reach-in access to the lighted interior product area of a refrigerated merchandiser, the door comprising:

an unsealed glass subassembly having first and second spaced apart glass lites with inward and outward facing surfaces, a unitary spacer extending around and in contact with an outer periphery of the glass lites and having a separator section disposed between said glass lites and flanges integrally formed as one piece with the separator section to engage outer peripheral edges of said glass lites, and key locking means cooperatively engaged with said spacer for lockingly maintaining it in peripheral contact around the glass lites; and a molded frame surrounding the outer periphery of the glass subassembly and sealably encasing said spacer and adjacent marginal edges of said glass lites around the flanges.

2. The door of claim 1, in which said glass subassembly is unsealed against fluid passage, and in which said spacer is formed of thermally insulative material.

3. The door of claim 1, in which said glass subassembly is unsealed against fluid passage, and in which said spacer is formed of electrically insulative material.

4. The door of claim 1, in which said glass subassembly is unsealed against fluid passage, and further includes a moisture barrier constructed and arranged for covering the outer periphery of said spacer around said glass lites.

5. The door of claim 4, wherein said moisture barrier is further constructed and arranged for covering the key locking means at said spacer.

6. The door of claim 4, wherein said moisture barrier covers an outer wall surface of said spacer and extends around the flange thereof to overlap a predetermined outer surface area of said glass lites adjacent to the peripheral marginal edges thereof.

7. The door of claim 6, wherein said moisture barrier is disposed intermediate of said glass subassembly and said molded frame, and said molded frame sealably encloses a greater outer surface area of the glass lites than said moisture barrier.

8. The door of claim 6, in which said moisture barrier is formed of a metal material.

9. The door of claim 8, wherein said moisture barrier material is aluminum.

10. The door of claim 1, wherein said glass lites have angularly related side edges, and said spacer comprises a one-piece strip of flexible, non-conductive material having a continuous base wall member with said flanges forming parallel side portions thereof and together defining a continuous outer wall surface on one side of the spacer, said separator section being formed on the other side opposite to said one side and intermediate to the side flanges, and said separator section being divided into a series of lengths corresponding to the lengths of the respective side edges of the glass lites and being connected together by the continuous base wall member.

11. The door of claim 10, in which said separator section is chamfered between said lengths to accommodate bending and shaping the flexible strip spacer along the angularly related side edges of said glass lites such that the opposed edges of said separator section lengths at the respective chamfers are mated at the corners of the glass lite side edges to form a mitered continuous separator body section in the subassembly.

12. The door of claim 11, in which the outer ends of the strip spacer are free and are disposed in adjacent opposed relationship on one side edge of the glass lites in forming the glass subassembly, and said key locking means is constructed and arranged for mating locking engagement between the free spacer ends to hold them together and complete the peripheral spacer engagement with the marginal edges of the glass lites.

13. The door of claim 12, wherein a locking tab is formed on one of said key locking means and free spacer ends and a tab receiving channel is formed in the other of said key locking means and free spacer end.

14. The door of claim 13, wherein said locking tab and tab receiving channel have cooperative dual snap locking means in the form of a beveled key as one of said dual means and a key opening as the other of said dual means.

15. The door of claim 13, wherein the free ends of said strip spacer have an interior cavity defining said tab receiving channel and said key locking means has a locking body section with said locking tab extending in aligned opposite directions therefrom.

16. The door of claim 15, in which said locking body section is configured to match and mate with said spacer so as to have similar aligned flanges and separator sections for engagement with the glass lites.

17. The door of claim 1, including heating means for heating at least one of said glass lites, and including electrically conductive means constructed and arranged in abutment with said spacer for accommodating an electrical connection to said heating means.

18. The door of claim 17, in which said heating means for said glass lites comprises a conductive transparent film applied to the inwardly facing surface of one of said first and second glass lites, and said electrically conductive means includes bussing means for electrically contacting said film along parallel opposite sides of said one glass lite.

19. The door of claim 18, in which said electrically conductive means comprises another electrical conductor extending along an inwardly facing side of the other of said first and second glass lites disposed opposite to a third side of the one glass lite which is perpendicular to the parallel opposite sides thereof.

20. The door of claim 19, in which said electrical conductor and bussing means are received in side wall channels of said separator section of said spacer and disposed against the adjacent inner surfaces of the opposed lites so as to be entirely covered by the spacer.

21. The door of claim 19, including crossover electrical connectors laterally extending across said glass subassembly to connect the bussing means of said one glass lite to the electrical conductor at the opposite other glass lite.

22. The door of claim 21, wherein said spacer includes notched kerfs to accommodate said crossover connectors.

23. The door of claim 18, in which said key locking means includes an electrical connector section constructed and arranged to receive electrical power from an exterior source and being constructed and arranged for connection thereof to said electrically conductive means on said spacer.

24. The door of claim 23, in which said electrical connector section of said key locking means is formed integrally with a locking section thereof, said locking section having externally located electrical leads in contact with the electrically conductive on said spacer means, and means internally of said electrical connector and locking sections for forming the electrical power connection to said electrical leads.

25. The door of claim 24, wherein there are two electrical leads extending externally of said locking section and being turned to extend in opposite directions away from each other along the spacer, one of said glass lites having an electrically conductive film on an inward surface thereof, and said electrically conductive means extending along selected portions of said spacer to connect said electrical leads to said conductive film.

26. The door of claim 25, in which said electrically conductive means comprises connector strips in electrical contact with the electrical leads and extending therefrom along a side wall of the spacer to the outer ends thereof, said side wall being in contact with the inward surface of the other glass lite and in spaced relation with the conductive film on said one glass lite.

27. The door of claim 26, in which said connector strips are disposed along a vertical side wall of the spacer to extend to the upper and lower corners thereof against the other of said glass lites, said electrically conductive means further comprises conductor means for extending along the upper and lower horizontal edges of said spacer in contact with the conductive film on said one glass lite, and crossover connectors connecting said connector strips and conductor means.

28. The door of claim 1, including door control means adapted for hingedly mounting said door on the casing of a refrigerated merchandiser, said door control means comprising upper and lower hinges accommodated by upper and lower bushings positioned in said molded frame.

29. The door of claim 28, including a horizontally extending structural reinforcement secured to at least one of said bushings.

30. The door of claim 29, in which the one bushing and its structural reinforcement are molded into said frame, and bearing means is received in said one bushing for pivotally mounting a hinge therein.

31. The door of claim 28, including spring means for biasing said upper hinge in an upward direction.

32. The door of claim 28, in which the lower hinge is mounted for relative movement in a bearing sleeve accommodated by the lower bushing, and the lower end of said lower hinge being adapted for non-turning engagement in casing of the refrigerated merchandiser.

33. The door of claim 28, in which said door control means comprises torsion means constructed and arranged for twisting action during opening and closing of the door on the casing, said torsion means being elongate and having one fixed relative to the door and the other end secured, in use, to the refrigerated merchandiser casing.

34. The door of claim 33, including torque adjustment means secured to the one end of said torsion means and being constructed with gearing means for selectively applying a twisting force whereby the door is biased, in use, toward a self closing position on the refrigerated merchandiser.

35. The door of claim 34, in which said torque adjustment means is located in the hinging margin of the molded door frame, and includes means for operating said gearing means to vary the degree of twisting force on said torsion means.

36. The door of claim 1, in combination with a door frame casing on which the door is movably mounted, including door control means comprising upper and lower hinges accommodated by the molded door frame.

37. The door of claim 36, in which the door control means also includes torsion means constructed and arranged for twisting action during opening and closing of the door relative to the casing.

38. A transparent door that, in use, is movably mounted to provide reach-in access to the lighted interior product area of a refrigerated merchandiser, the door comprising:

a transparent panel with a glass subassembly having at least two glass lites, an integral one-piece spacer member formed to span across and engage the marginal edges of said glass lites and to maintain a spaced relation therebetween, and a key locking member for maintaining said spacer member assembled in peripheral contact around the glass lites;

a molded frame sealably surrounding the outer periphery of the glass subassembly;

door control means for hingedly mounting said door; and electrical means including heating means for heating at least one of the glass lites of the transparent panel and means for connecting said heating means through said key locking member.

39. The door of claim 38, in which the transparent door panel comprises first and second glass lites and said spacer member is formed of non-conductive bendable material to extend peripherally around the glass lites, said spacer member having opposed and adjacent free ends and said key locking member having a locking section constructed and arranged to connect said opposed spacer free ends in locking relationship to hold said glass lites and form an unsealed glass panel subassembly.

40. The door of claim 39, in which the spacer member has an inner separator body portion with an outer wall forming side sealing flanges on each side of the body portion, and said first and second glass lites are assembled on the spacer member with the separator body portion engaging the opposed inner surfaces of the glass lites and the peripheral margins of the lites being captured by the side sealing flanges of the spacer member.

41. The door of claim 40, in which the separator body portion is bifurcated in two sections separated by a central flange of the outer wall, and a third glass lite is centrally assembled between the two separator body sections in spaced relation with the first and second glass lites and with its peripheral margin engaged with the central flange.

42. The door of claim 41, in which one of the glass lites is formed of low-E glass.

43. The door of claim 40, in which the outer surface of the spacer member outer wall and side sealing flanges is covered with a moisture barrier material.

44. The door of claim 43, wherein said moisture barrier material is applied to peripherally cover the outer wall surface around the glass panel subassembly and also extends inwardly from said outer wall surface around said side flanges to overlap a preselected outer surface area of said first and second lites adjacent to the peripheral margins thereof.

45. The door of claim 40, in which said molded frame is formed of a polymeric material and is arranged and molded to surround the peripheral margin of the transparent panel and sealably enclose said lites so that the interior volume of the panel comprises a sealed insulating space.

46. The door of claim 45, in which said inner separator body portion of said spacer member has a hollow interior cavity constructed and arranged to contain a desiccant and being in fluid communication with the interior volume of the transparent panel.

47. The door of claim 38, wherein said glass lites have angularly related side edges, and said spacer member comprises a strip of flexible, non-conductive material having a continuous base wall with side flanges forming parallel side portions thereof and together defining an outer wall surface on one side of said spacer member, said separator section being centrally formed on the other side between the side flanges, and said separator section being divided into a series of lengths corresponding to the respective side edges of the glass lites and being connected together by the base wall member.

48. The door of claim 47, in which said separator section is chamfered between said lengths to accommodate bending and shaping the flexible strip spacer member along the angularly related side edges of said glass lites such that the opposed edges of said separator section lengths of the respective chamfers are mated at the corners of the glass lite side edges to form a mitered continuous separator body section in the subassembly.

49. The door of claim 48, in which the outer ends of the spacer member are free and are disposed in adjacent opposed relationship on one side edge of the glass lites in forming the glass subassembly, and said key locking member is constructed and arranged for mating locking engagement between the free spacer ends to hold them together and complete the peripheral spacer engagement with the marginal edges of the glass lites.

50. The door of claim 49, wherein a locking tab is formed on one of said key locking member and free spacer end and a tab receiving channel is formed in the other of said key locking member and free spacer end, said locking tab and tab receiving channel having cooperative dual snap locking means in the form of a beveled key as one of said dual means and a key opening as the other of said dual means.

51. The door of claim 50, wherein the free ends of said spacer member have an interior cavity defining said tab receiving channel, and said key locking member has a locking body section with said locking tab extending in aligned opposite directions therefrom, said locking body section being configured to match and mate with said spacer member so as to have similar aligned side flanges and separator body portions.

52. The door of claim 38, in which said heating means for said glass lites comprises a conductive transparent film applied to the inwardly facing surface of one of said glass lites, and said means for connecting includes bussing means in electrical contact with said film along parallel opposite sides of said one glass lite.

53. The door of claim 52, in which said means for connecting comprises another electrical conductor extending along a remote inward side of the other of said glass lites and a crossover electrical connector laterally extending across said glass subassembly for connecting the bussing means of said one glass lite to the electrical conductor at the other glass lite.

54. The door of claim 38, in which said key locking member includes an electrical connector section constructed and arranged to receive electrical power from an exterior source and being formed integral with a locking section for said spacer member, said locking section having externally located electrical leads and means internally of said connector and locking sections for forming an electrical power connection there through to said electrical leads.

55. The door of claim 36, in which the door control means is adapted for hingedly mounting said door on the casing of a refrigerated merchandiser and includes upper and lower hinges accommodated by upper and lower bushings within said molded frame.

56. The door of claim 55, including a horizontally extending structural reinforcement secured to at least one of said bushings, and in which the one bushing and structural reinforcement are molded into said frame, and another bearing means received in said one bushing for pivotally mounting one of the hinges therein.

57. The door of claim 56, in which said upper hinge freely turns in said bearing and is biased in an upward direction by a spring, and in which the lower hinge is mounted for relative movement in a lower bearing accommodated by the lower bushing with its lower hinge end being adapted for non-turning engagement relative to the casing of the refrigerated merchandiser.

58. The door of claim 55, in which said door control means comprises torsion means constructed and arranged for twisting action during opening and closing of the door, said torsion means being elongate and having one end fixed relative to the door and the other end secured, in use, to the refrigerated merchandiser.

59. The door of claim 58, including torque adjustment means secured to the one end of said torsion means and being constructed with gearing means for selectively applying a twisting force whereby the door is biased, in use, toward a self closing position on the refrigerated merchandiser.

60. The door of claim 59, in which said torque adjustment means is located in the hinging margin of the molded door frame, and includes means for operating said gearing means to vary the degree of twisting force on said torsion means.

61. The door of claim 38, in combination with a door frame casing on which the door is movably mounted, including door control means comprising upper and lower hinges accommodated by the molded door frame.

62. The door of claim 61, in which the door control means also includes torsion means constructed and arranged for twisting action during opening and closing of the door relative to the casing.

63. A transparent door that, in use, is movably mounted to provide reach-in access to the lighted interior product area of a refrigerated merchandiser, the door comprising:

a glass subassembly having first and second spaced apart glass lites with inward and outward facing surfaces, an integral one-piece strip spacer formed to extend peripherally around and engages the glass lites and having an inner separator body portion with an outer wall forming side sealing flanges on each side of the body portion, said first and second glass lites being assembled on the strip spacer with the separator body portion engaging the opposed inner surfaces of the glass lites and the side sealing flanges overlying the peripheral edges margins of the lites;

a molded frame surrounding the outer periphery of the glass subassembly and sealably encasing said strip spacer, said strip spacer being constructed and arranged for blocking frame molding material from entering between the first and second glass lites during molding assembly.

64. The door of claim 63 wherein the outer wall extends continuously from side flange to side flange thereby forming an unbroken barrier to the frame molding material.

65. The door of claim 63 wherein the separator body portion includes at least one sealing lip extending from the separator body portion and further engages an inner surface of one of the glass lites for inhibiting ingress of frame molding material between the glass lites.

66. The door of claim 65 wherein the separator body portion comprising two sealing lips, a first of the lips extending from the separator body portion and engaging an inner surface of the first lite and a second of the lips extending from the separator body portion and engaging an inner surface of the second lite, the outer wall and sealing lips inhibiting ingress of frame molding material between the glass lites.

67. The door of claim 63, in which the separator body portion is bifurcated into two sections separated by a central flange of the outer wall, and a third glass lite is centrally assembled between the two separator body sections in spaced relation with the first and second glass lites and with its peripheral margin engaged with the central flange.

68. The door of claim 63, in combination with a door frame casing on which the door is movably mounted, including door control means comprising upper and lower hinges accommodated by the molded door frame.

69. The door of claim 68, in which the door control means also includes torsion means constructed and arranged for twisting action during opening and closing of the door relative to the casing.

70. A transparent door that, in use, is movably mounted to provide reach-in access to the lighted interior product area of a refrigerated merchandiser, the door comprising:

an unsealed glass subassembly having first and second glass lites assembled in spaced relation on a peripheral one-piece strip spacer said spacer extending around and engaging an outer peripheral edges of each of said glass lites;

a molded frame sealably encasing the glass subassembly and having a vertical inner hinge margin and transverse upper and lower ends;

a first hinge pin at one of the upper and lower ends of the frame for its pivotal connection to the refrigerated merchandiser, the first hinge pin being constructed and arranged for turning connection in the frame whereby the frame pivots with respect to the first hinge pin; and means for seating the end of the first hinge pin for non-turning movement on the refrigerated merchandiser;

an elongate torsion rod having a first end fixedly connected to the first hinge pin and another end fixedly connected to the frame such that, in use, swinging movement of the door in an opening direction relative to the merchandiser will twist the torsion rod about its longitudinal axis whereby the torsion rod applies a spring force opposing the opening direction for biasing the door toward a closed position;

a first gear mounted on said other end of the torsion rod for conjoint movement therewith about the longitudinal axis of the torsion rod; and a second gear mounted within the door frame and engageable with the first gear for selectively rotating the first gear to preadjust the torsional spring force of the rod.

71. The reach-in door of claim 70 wherein the inner hinge margin of the molded door frame is constructed and arranged so that the second gear is accessible for selective rotation to adjust the spring force of the torsion rod.

72. The door of claim 70, in combination with a door frame casing on which the door is swingably mounted, including door control means comprising said first hinge pin and another second hinge pin accommodated by the molded door frame.

73. A transparent door that, in use, is movably mounted to provide reach-in access to the lighted interior product area of a refrigerated merchandiser, the door comprising:

a glass panel having first and second generally rectangular spaced apart lites having peripheral edges, the first lite having an inner surface formed with electrically conductive film thereon;

an integral one-piece spacer of electrically insulating material disposed generally between the lites and engaging the peripheral edges of the lites;

a molded frame surrounding the peripheral edges of the first and second lites and encasing the one-piece spacer, the door being constructed with heating means for heating the electrically conductive film to clear condensation on the glass panel during use of the door on the merchandiser;

said heating means including a first flat, elongate bus bar disposed between the spacer and the first lite along one of the peripheral edges of the first lite, the first bus bar engaging the inner surface of the first lite to permit electrical conduction between the first bus bar and the electrically conductive film thereon;

a second flat, elongate bus bar disposed between the spacer and the first lite along an opposed peripheral edge of the first lite opposite to the first bus bar, the second bus bar engaging the inner surface of the first lite to permit electrical conduction between the second bus bar and the electrically conductive film on the inner surface;

the first and second bus bars being constructed and arranged for connection to an electrical power source external of the door thereby to permit an electrical current to flow in the electrically conductive material on the inner surface of the first lite for generating heat on said inner surface.

74. The transparent reach-in door of claim 73, wherein the spacer has an inner separator body with side wall surface for contacting the inner surface of the first lite, and wherein the first and second bus bars are covered by the spacer side wall surfaces.

75. The transparent reach-in door of claim 74, wherein the molded frame is made of a polymeric material molded onto the spacer and around the first and second lites, the first and second bus bars being confined to a spacer area contained within the molded frame whereby the bus bars are shielded from incidental contact in the event of breakage of the first lite.

76. The transparent reach-in door of claim 75, wherein the first and second bus bars are foil adhered to one of the spacers and the inner surface of the first lite.

77. The transparent reach-in door of claim 74 further comprising at least one conductor disposed between the spacer and the inner surface of the second lite along one of the peripheral edges of the second lite, the spacer and second lite electrically insulating the conductor.

78. The transparent reach-in door of claim 77, wherein the molded frame is made of a polymeric material molded onto the spacer and around the first and second lites, the conductor being confined to a spacer area contained within the molded frame whereby the conductor is shielded from incidental contact in the event of breakage of the second lite.

79. The transparent reach-in door of claim 77 further comprising crossover connectors extending transversely through the spacer between said first and second lites and electrically connecting the conductor to the first and second bus bars.

* * * * *